United States Patent [19]

Balz

[11] 4,034,519

[45] * July 12, 1977

[54] FINISHING APPARATUS AND METHOD HAVING COOPERATING MOVABLE PART-ISOLATING MEANS AND DISCHARGE PORT

[75] Inventor: Gunther W. Balz, Kalamazoo, Mich.

[73] Assignee: Roto-Finish Company, Kalamazoo, Mich.

[ * ] Notice: The portion of the term of this patent subsequent to Sept. 21, 1993, has been disclaimed.

[21] Appl. No.: 648,901

[22] Filed: Jan. 14, 1976

Related U.S. Application Data

[63] Continuation of Ser. No. 414,656, Nov. 12, 1973, Pat. No. 3,981,693.

[51] Int. Cl.[2] ..... B24B 31/06

[52] U.S. Cl. ..... 51/163.1; 51/313

[58] Field of Search ..... 51/7, 163.1, 163.2, 51/17, 19, 313

[56] References Cited

U.S. PATENT DOCUMENTS

| | | | |
|---|---|---|---|
| 3,422,577 | 1/1969 | McKibben | 51/163.2 |
| 3,423,884 | 1/1969 | Balz | 51/163.2 |
| 3,464,163 | 9/1969 | Ferrara | 51/19 X |
| 3,611,638 | 10/1971 | Dude | 51/163.1 |
| 3,792,552 | 2/1974 | Isaacson | 51/163.1 |

FOREIGN PATENT DOCUMENTS

| | | | |
|---|---|---|---|
| 959,849 | 6/1964 | United Kingdom | 51/163.1 |
| 841,723 | 7/1960 | United Kingdom | 51/7 |

*Primary Examiner*—Harold D. Whitehead
*Attorney, Agent, or Firm*—Gordon W. Hueschen

[57] ABSTRACT

A machine for finishing parts, having part-isolating means such as vertical partitions or dividers, defining one or more compartments, disposed at least partially within the finishing chamber, each compartment designed to accept a part or parts to be finished and to maintain parts isolated from other parts. The finishing chamber and the part-isolating means are movable with respect to each other. As a result, as the part moves along the finishing chamber during the course of the finishing process, the compartment defined by the part-isolating means, e.g., partitions, moves longitudinally with the part and isolates it from other parts. In one embodiment of the invention, the part-isolating means, such as partitions for defining compartments for the parts, moves vertically with respect to the finishing chamber. Vertical movement is controlled by devices such as solenoids or air-operated cylinders in turn controlled by timers, permitting precise control of the finishing period. The vertical movement is so controlled that at the proper times the parts are released to advance to the space beyond the partition. Thus, in effect, the compartment surrounding the part and isolating it from other parts, moves with the part. In another embodiment the partitions are arranged to move longitudinally with the parts, and means are provided for retarding or stopping the parts longitudinally. In still another embodiment, means is provided for separating finishing material from the parts and discharging finished parts. The finishing machines may be curvilinear or annular gyratory motion-type machines, linear tub-type machines, or any of various types of tumbling machines. Method of finishing whereby any and all of the foregoing objectives are accomplished.

The present application claims such improved finishing apparatus wherein the moveable part-isolating means cooperates with a discharge port in the finishing chamber to facilitate discharge of contents of an individual compartment defined by adjacent partitions.

16 Claims, 60 Drawing Figures

128
139
130
131
140
146
146
129
126
146
135
143
133
134
132
142
136
137
127

146
145
144
138
130
146
141
139
131
146
146
140
142
146
143
133
134
146
137
136

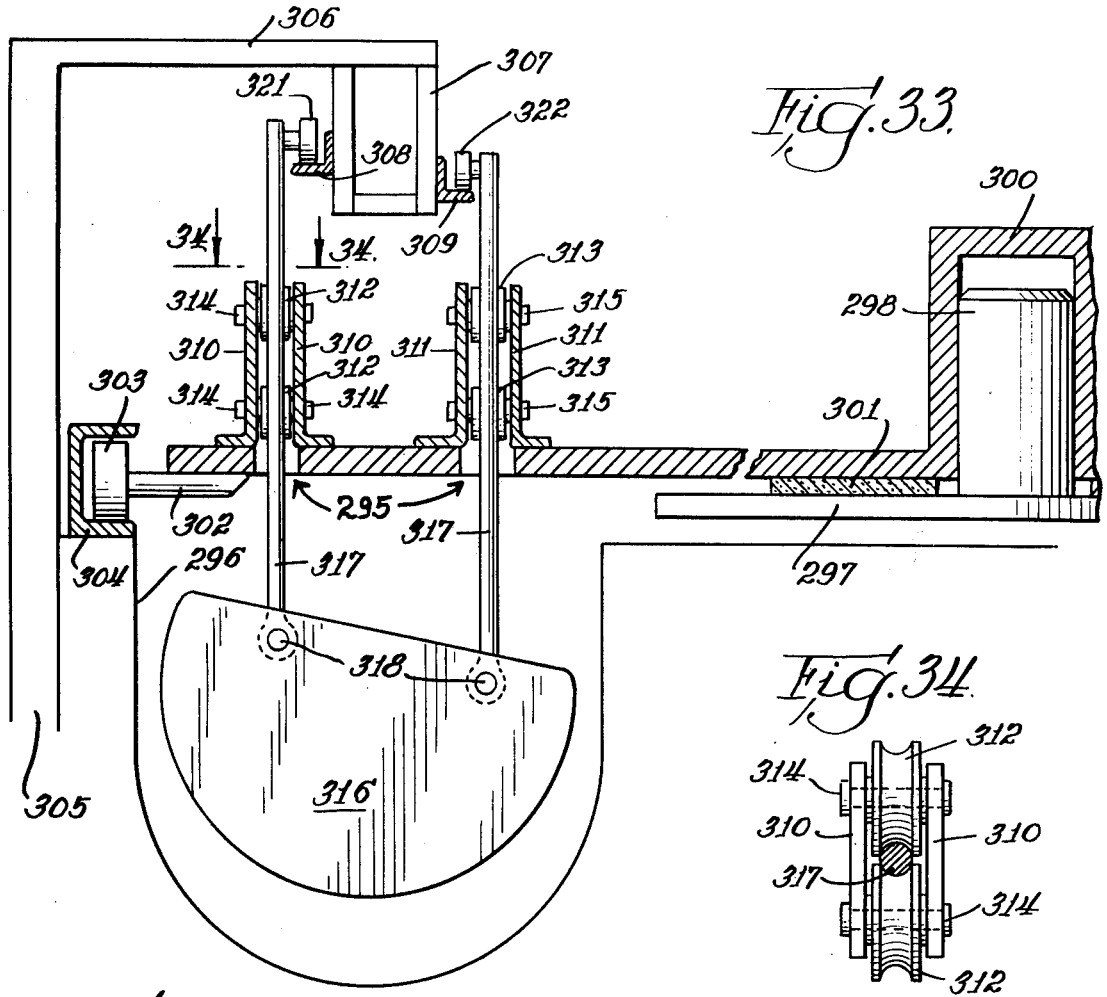
Fig. 33.
Fig. 34.
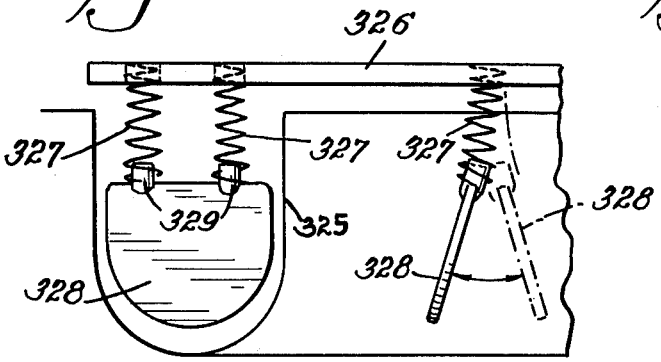
Fig. 35.
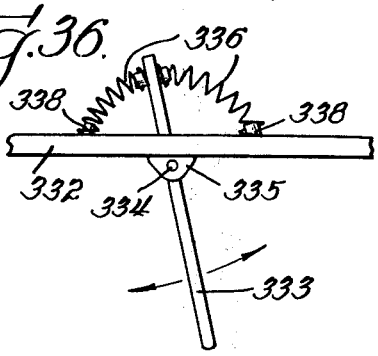
Fig. 36.
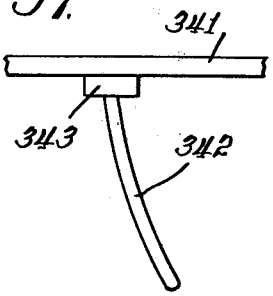
Fig. 37.
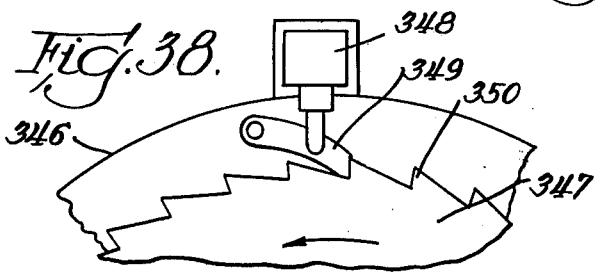
Fig. 38.

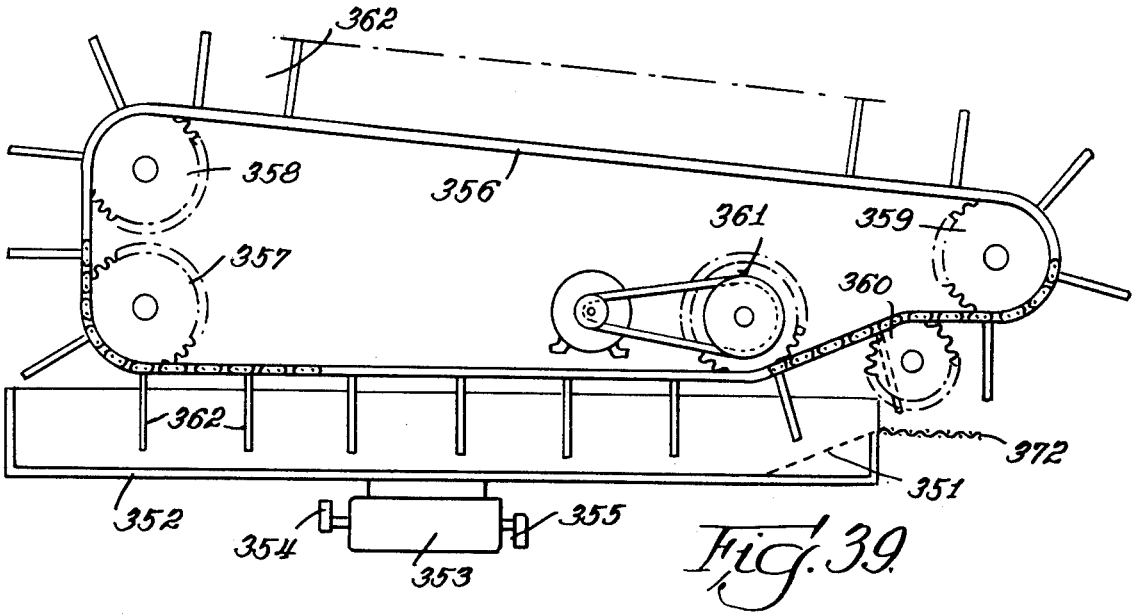
Fig. 39
Fig. 40
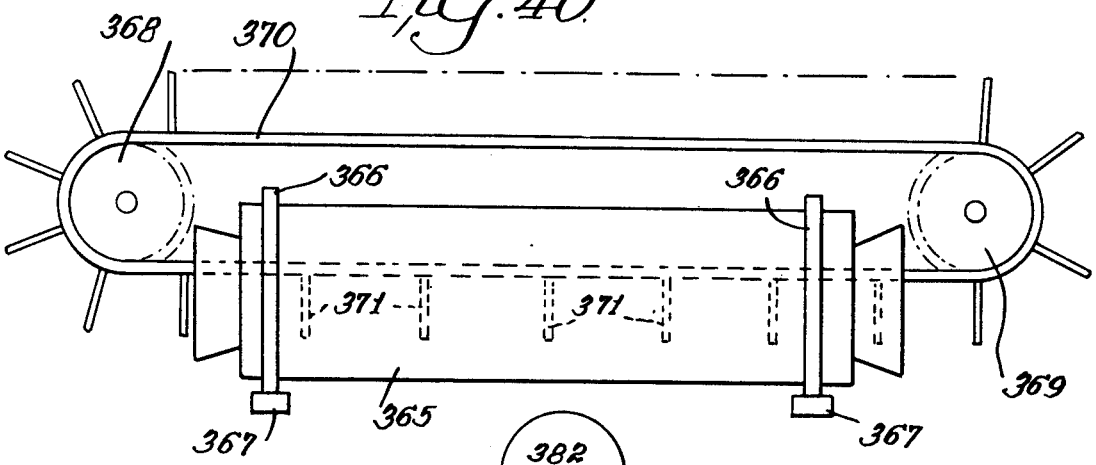
Fig. 41
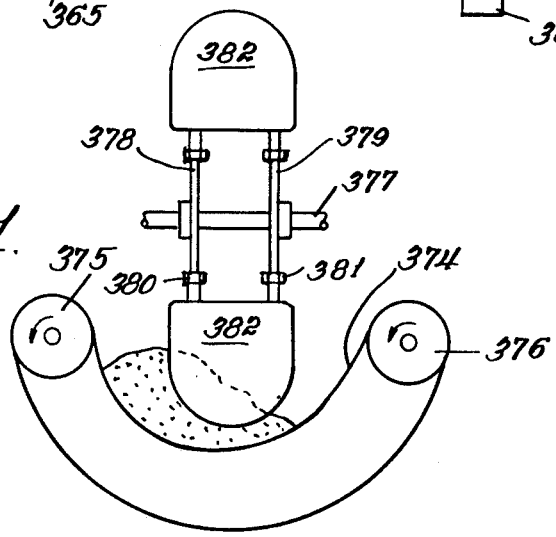

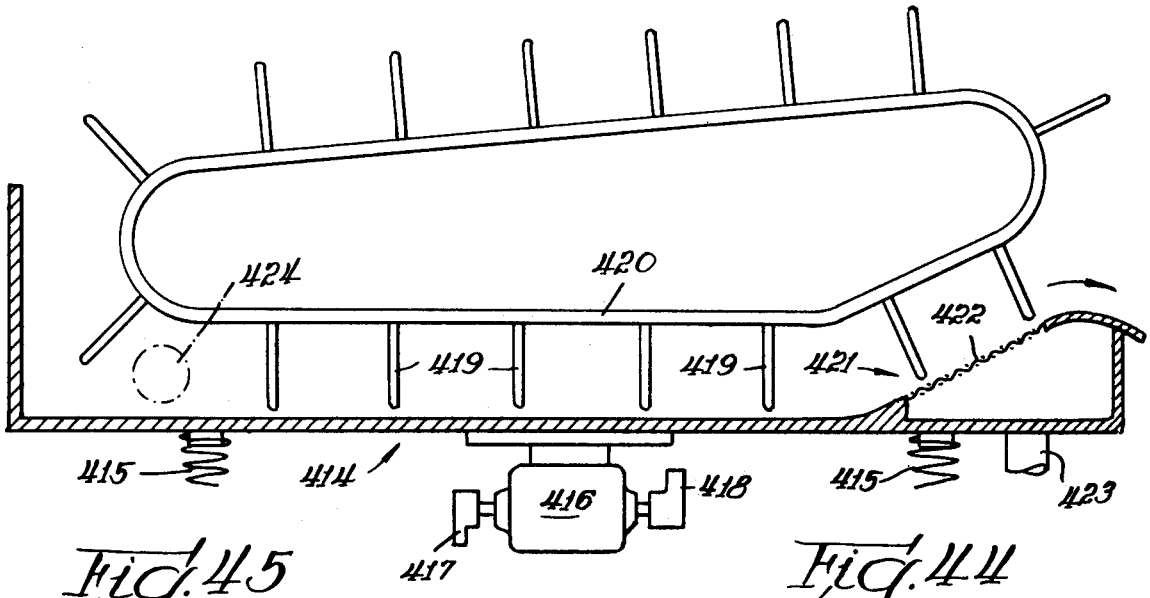
Fig. 45
Fig. 44
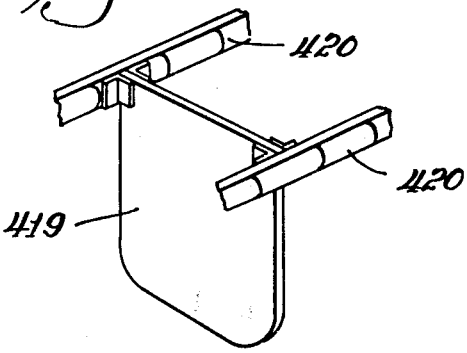
Fig. 46
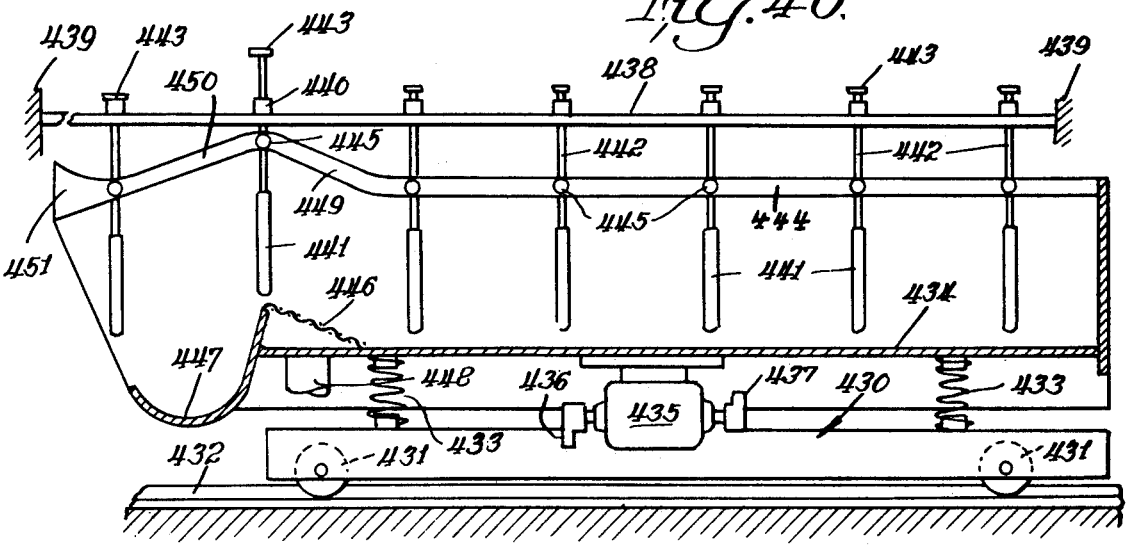

Fig. 47.
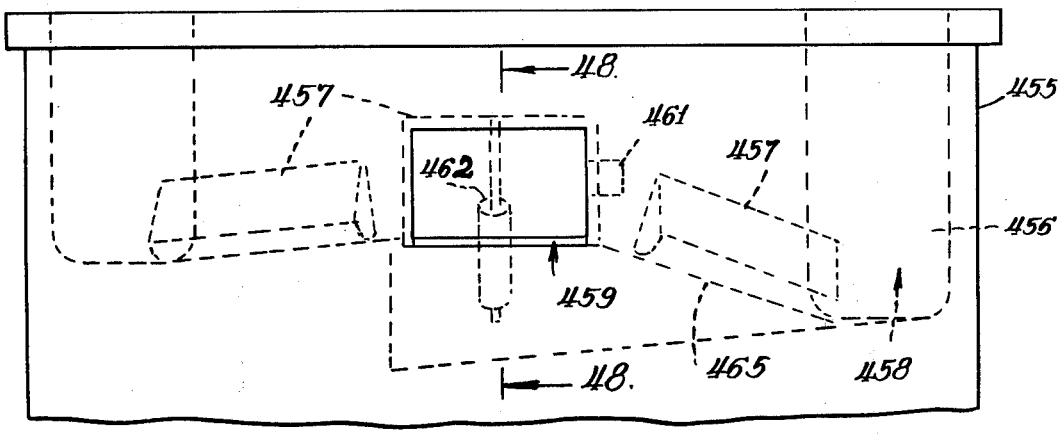
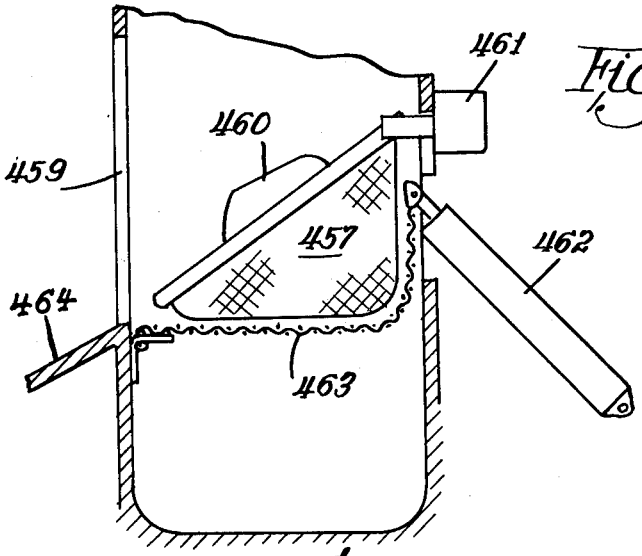
Fig. 48.
Fig. 49.
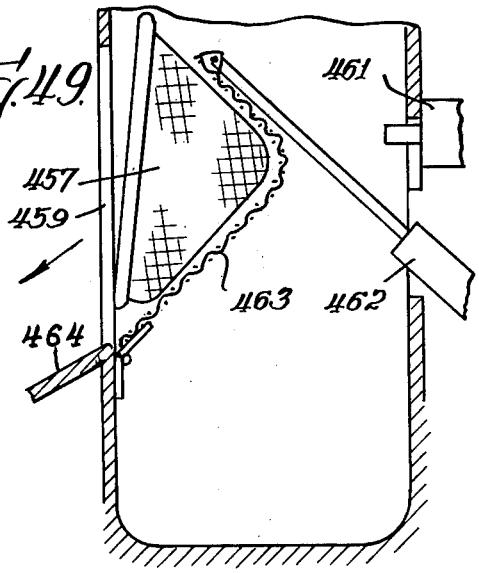
Fig. 50.
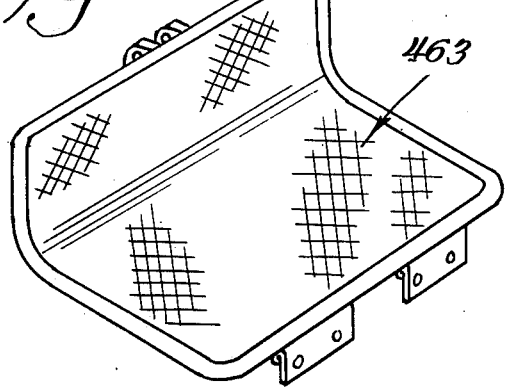
Fig. 51.
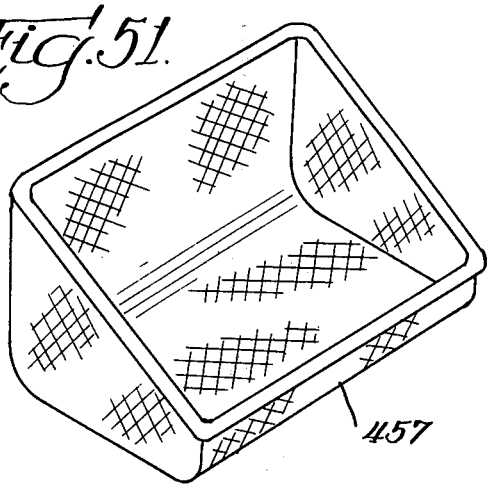

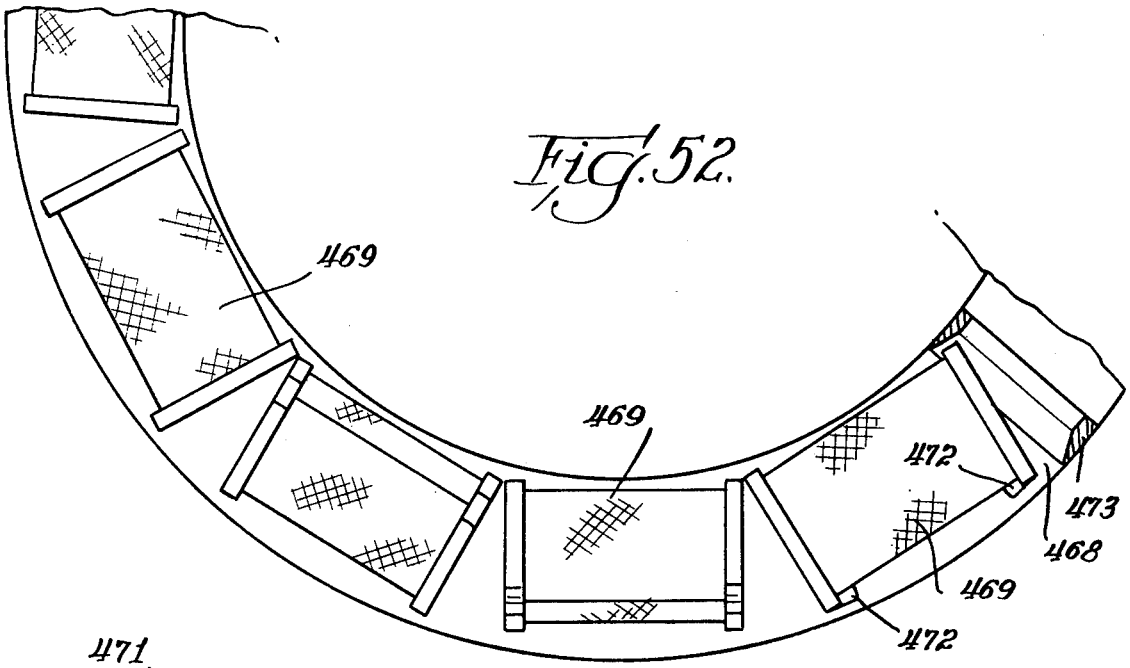
Fig. 52.
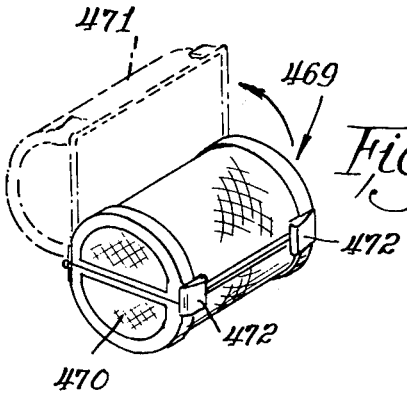
Fig. 53
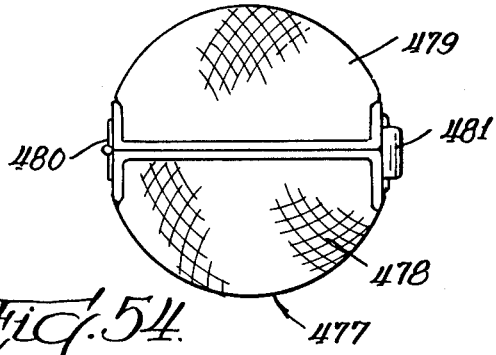
Fig. 54.
Fig. 55
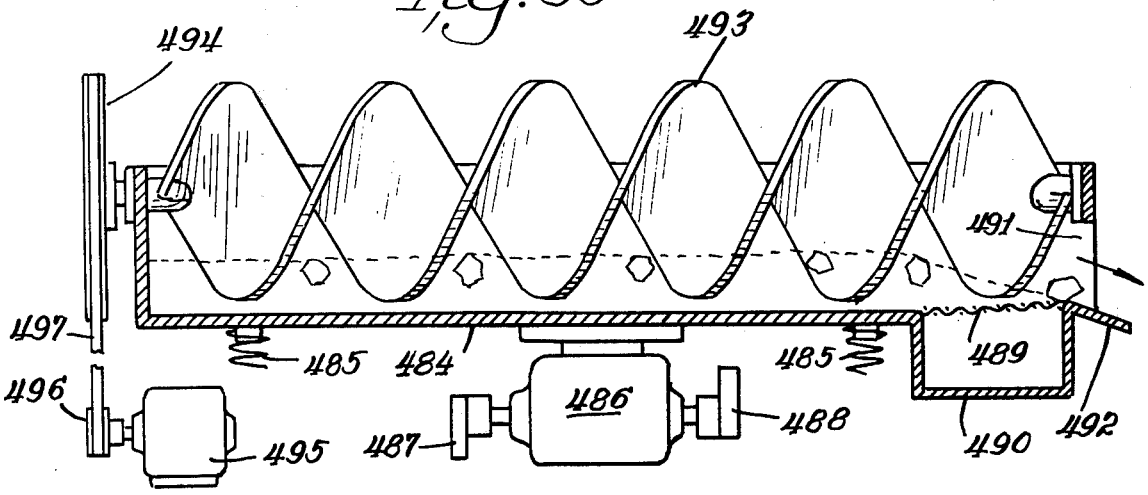

FINISHING APPARATUS AND METHOD HAVING COOPERATING MOVABLE PART-ISOLATING MEANS AND DISCHARGE PORT

The present application is a continuation of my prior-filed co-pending application Ser. No. 414,656, filed Nov. 12, 1973 and now U.S. Pat. No. 3,981,693, dated Sept. 21, 1976.

BACKGROUND OF THE INVENTION

1. Field of Invention

The present invention relates to finishing machines, being especially adapted for use in or with vibratory finishing machines and particularly those having a curvilinear finishing chamber and vertically oriented gyratory motion-producing assembly and power driving means.

2. Prior Art

Finishing machines and especially vibratory finishing machines are well known in the art. Such machines are used for various forms of finishing, such as burr removal, burnishing, and polishing. Such machines are disclosed and claimed in U.S. Pat. Re. Nos. 27,084, 3,400,495, 3,423,884, 3,435,564, 3,466,815, 3,606,702, and 3,633,321. Machines of the type described generally have a finishing chamber and a motor operatively mounted with respect to the chamber and arranged to cause eccentric weights to rotate or revolve, thereby producing vibratory motion of the finishing chamber. In one form disclosed in the prior art, a tub-type of finishing chamber, usually linear, has a motor with eccentric weights mounted on the shaft of the motor directly mounted to the tub, or a shaft with eccentric weights mounted to the tub and motor driven. In another type, the eccentric weights are mounted out of phase on a vertical shaft, causing the finishing chamber which is generally curvilinear to undergo gyratory motion. In either type, as a result of the vibratory movement, when materials such as parts and/or finishing materials are placed in the chamber, orbital motion is imparted to the contents so that they move upwardly at the peripheral portion of the chamber and downwardly at the inner portion of the chamber. This results in relative movement between the finishing material and parts, or at least interaction therebetween, causing the parts to be finished. Additionally, by employment of a proper phase relationship between the eccentric or unbalance weights, varying degrees of precession or linear progression of the material and parts are caused circumferentially around the annular finishing chamber, or linearly in the tub-type, as is well-known in the art. Various forms of guides or vanes, including helical guides, have also been fixed internally of a finishing chamber to assist with such precession. See, for example, U.S. Pat. No. 3,071,900.

Prior art finishing machines, e.g., tumbling machines and vibratory finishing machines, such as described above, generally function well. However, they all suffer from at least one disadvantage. During the finishing process, there is a tendency for closely adjacent parts to collide with each other as a result of the tumbling or vibrational movement imparted to them, often resulting in considerable damage to the parts by denting or fracture. In U.S. Pat. No. 3,423,884, a finishing apparatus is disclosed wherein the entire finishing machine may be mounted for rotation by an adjoining motor and belt assembly. The finishing chamber is divided into a plurality of compartments which are stationary with respect to the finishing chamber, the entire assembly if desired rotating during the finishing process. This apparatus succeeds in isolating high precision and easily damageable parts so that they are safely finished. However, no unloading means have been provided or suggested for such machine and it is necessary that each part be unloaded by hand. The cost of labor utilized in manually loading of parts, separating parts from finishing media, and hand removal of finished parts from the finishing machine is extremely high, if not prohibitive. Finishing machines have also been devised utilizing spindles, wherein the parts are fixtured to a spindle during the finishing process. The cost of manually mounting the parts and removing them in such devices is also prohibitively high. Floating compartment devices are also known, but these are no better than fixed compartment machines and suffer from the same disadvantages as previously noted, e.g., the necessity of manual loading and separation and the high cost of labor associated therewith in the absence of any suggestion of automatic separation and how it might be effected in such devices.

As known in the art, parts-finishing cycle control or adjustment has been effected by controlling the phase relationship of the eccentric weights on the shaft driven by the motor. U.S. Pat. Nos. 3,435,564 and 3,466,815 show means for making such adjustment. This is a partially satisfactory way of operation, but it has the limitations that it does not permit precise or exact control of the parts-finishing cycle, and further, that it does not keep the parts evenly distributed in the finishing chamber. The method and apparatus of the present invention, on the other hand, does permit precise and exact control of the parts-finishing cycle, and does permit isolation of parts from other parts to prevent damage to the parts as a result of collision between them.

OBJECTS OF THE INVENTION

It is accordingly an object of the present invention to provide a finishing apparatus wherein parts-isolating means are provided for maintaining parts, which are particularly subject to damage by collision with adjacent parts isolated from other parts. It is an additional object to provide a finishing apparatus of the type described wherein the parts to be finished are permitted to move with respect to the chamber while still maintaining parts isolated from other parts. It is still an additional object to provide such an apparatus having means for automatically discharging the parts from the finishing chamber when the parts have been sufficiently finished. It is still another object to provide an apparatus for finishing parts while maintaining them isolated from other parts, which can utilize any of the commonly utilized methods of finishing parts. It is another object to provide means for maintaining parts in isolated condition during the finishing process, which apparatus can be readily adapted to existing conventional finishing apparatus. It is an additional object to provide a means for exact control of the finishing cycle by controlling the speed of the moving part, which permits exact timing of part entry, part exit, and time during which the parts remain in the machine during the finishing cycle, whereby the timing cycle can be so precisely controlled that the process may be synchronized to other machines operated in conjunction with the finishing machine. It is another object to provide a finishing machine of the type described in which the part-isolating means and finishing chamber move with respect to each other and whereby the finished parts are automatically separated, if desired after a precisely-timed finishing cycle, and if desired with automatic return of separated finishing material to the finishing chamber for reuse. It is still another object to provide a finishing machine of the type described which embodies part-isolating means which move vertically with respect to the finishing chamber, for changing the boundaries of compartments therein. It is another object to provide a method for finishing parts in which method parts are isolated from other parts during the finishing process, finished parts are preferably automatically separated, and whereby the finishing cycle may be precisely controlled if desired, optionally by creating moving boundary compartments in the finishing chamber. Still other objects will readily present themselves to one skilled in the art upon reference to the ensuing specification, drawings and claims.

BRIEF DESCRIPTION OF THE DRAWINGS

In the drawings,

FIG. 33 is a fragmentary sectional view showing still another modified embodiment of the partition and supporting structure.

FIG. 34 is a fragmentary cross-sectional view taken at the line 34—34 of FIG. 33, looking in the direction of the arrows.

FIG. 35 is a fragmentary cross-sectional view showing another embodiment of the partition structure and its support.

FIG. 36 is a fragmentary cross-sectional view showing still another embodiment of the partition and support.

FIG. 37 is a fragmentary cross-sectional view showing another embodiment of the partition.

FIG. 38 is a fragmentary plan view showing the structure for controlling the speed of the turntable of the apparatus of the embodiments of the invention.

FIG. 39 is a diagrammatic view showing an embodiment of the invention in which the finishing chamber is in linear form.

FIG. 40 is a side elevational view of an additional embodiment of the invention utilizing a linear finishing chamber.

FIG. 41 is an end elevational view of an embodiment of the invention utilized in conjunction with a belt tumbling apparatus.

FIG. 44 is an elevational view, partly in cross-section, showing a further embodiment of the invention utilizing a chain support for the part-isolating means.

FIG. 45 is a fragmentary perspective view showing a part-isolating partition and a portion of its supporting chain.

FIG. 46 is an elevational view partly in cross-section showing a still further embodiment of the invention using a linear finishing chamber.

FIG. 47 is an elevational view of another embodiment of the invention.

FIG. 48 is a cross-sectional view taken at the line 48—48 of FIG. 47, looking in the direction of the arrows.

FIG. 49 is a cross-sectional view at the same position as FIG. 48, but showing the apparatus in a different position.

FIG. 50 is a perspective view showing the basket tilting apparatus.

FIG. 51 is a perspective view of a foraminous basket for use with the apparatus FIGS. 47–50.

FIG. 52 is a fragmentary top view showing a finishing chamber having cylindrical baskets defining compartments for the parts arranged therein.

FIG. 53 is a perspective view of a cylindrical basket-type compartment.

FIG. 54 is an elevational view of a basket in the form of a sphere forming a compartment for finishing a part.

FIG. 55 is a side elevational view partly in cross-section of a linear-type finishing chamber having part-isolating means in the form of an auger or twisted ribbon.

DESCRIPTION OF THE PREFERRED EMBODIMENTS

Figure 1:
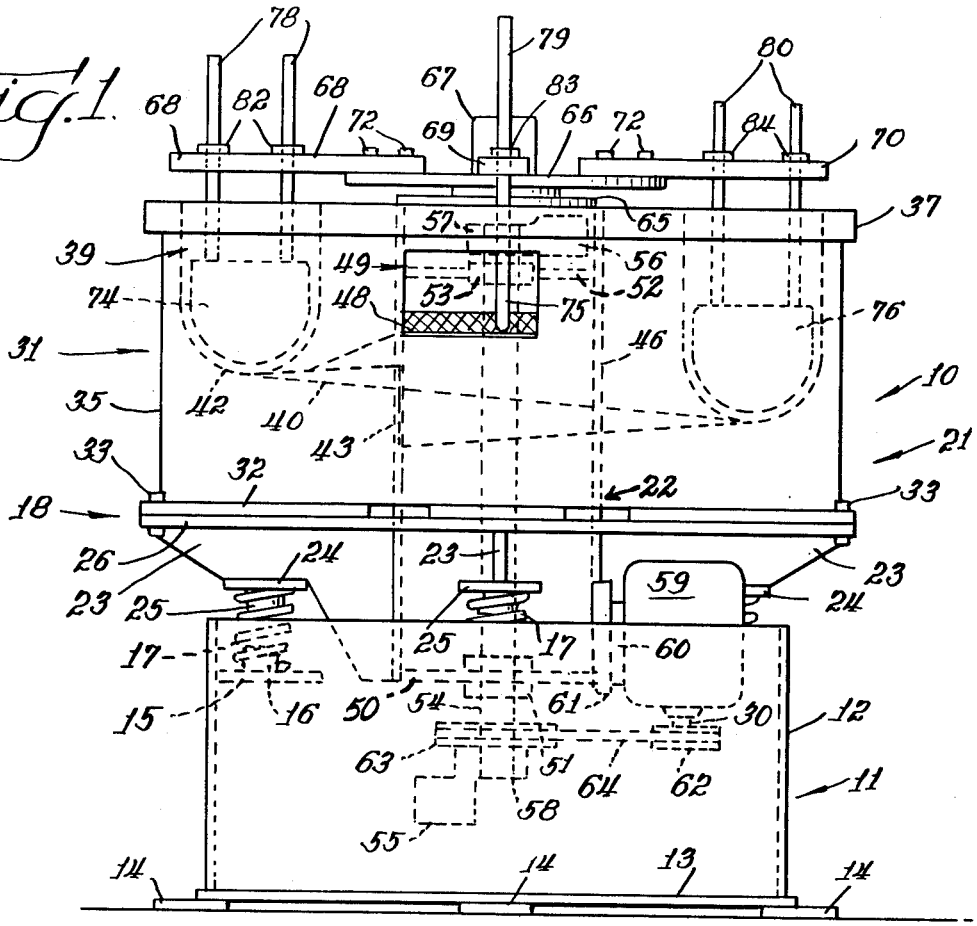
FIG. 1 is an elevational view of a finishing machine according to the invention.
Figure 2:
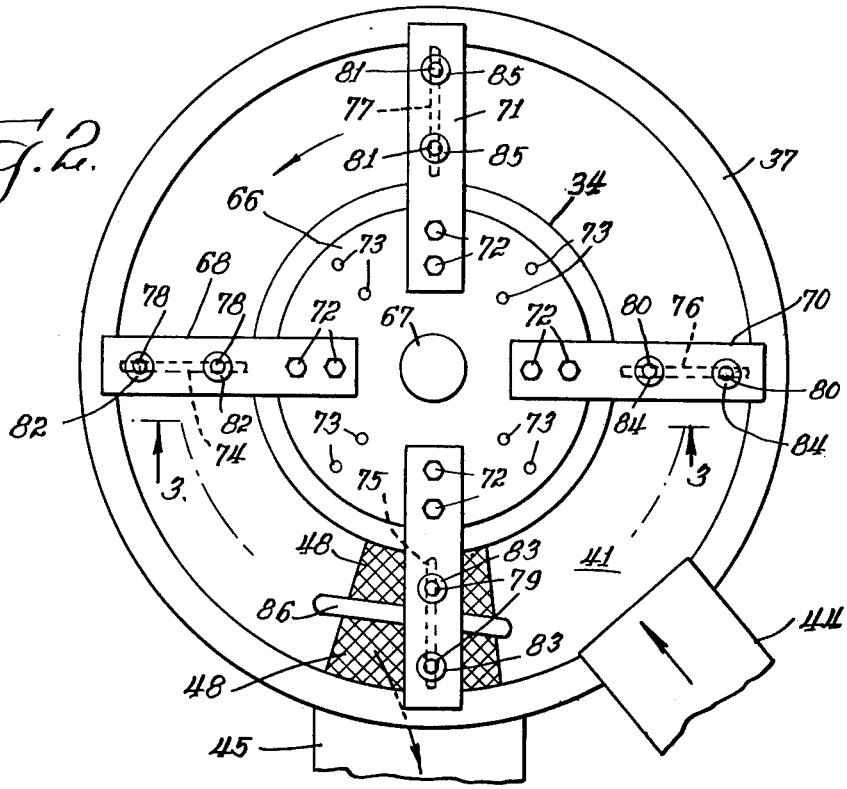
FIG. 2 is a top plan view of the finishing machine shown in FIG. 1.

Referring to FIGS. 1–4, a vibratory finishing apparatus 10 is shown comprising a fixed base 11 having a cylindrical wall 12, a bottom 13, square foot plates 14, and a radially directed annular flange 15. Spring-engaging protuberances 16 are affixed to the flange 15 for engaging one end of coil springs 17. Alternatively, a resilient material such as rubber or other elastic materials may be utilized in place of coil springs.

A floating supporting assembly 21 comprises a central tubular gyratory motion-producing assembly 22 and sheet-form radial supports 23. The radial supports 23 have square plates 24 affixed thereto on one edge which are provided with spring-engaging protuberances 25 on the other surfaces of the plates which engage the upper ends of the coil springs 17. Horizontal radial supporting arms 26 are affixed to the radial supports 23 by means such as welding. The radial supports 23 and the radial supporting arms 26 are welded to each other and to the central tube assembly 22.

Mounted on the floating support assembly 21 is an annular finishing chamber or tub assembly 31. The finishing chamber assembly 31 has four horizontally disposed radial arms 32 of substantially the same size and shape and which are detachably affixed to the radial supporting arms 26 by means of bolt and nut assemblies 33. Affixed to the radial arms 32 by means such as welding are an inner vertically arranged tubular finishing chamber support 34 and an outer vertically arranged tubular finishing chamber support 35. An annular channel-form rim 37 is affixed to the outer support 35 by means such as welding in order to reinforce the structure. An annular finishing chamber or tub 39 is disposed intermediate the supports 34 and 35 and affixed thereto by welding.

The central gyratory motion-producing assembly 22 comprises a vertically oriented tubular housing 46 affixed by welding at a lower portion thereof to the radial supports 23 and the radial supporting arms 26. The annular finishing chamber 39 may be any of a large number of different sizes and shapes. The chamber shown in FIGS. 1 and 2 has an arcuate bottom 42 and is in the form of a single turn helix, having a discharge zone 40 in one portion and a loading zone 41 in another. A vertical wall 43 separates the lowest portion of the bottom from the highest. Alternatively, finishing chambers having a horizontally arranged bottom or a helical bottom of more than one turn may be utilized. With such structures various separating devices known in the art may be utilized for removing the parts and returning the finishing material to the starting portion of the chamber.

Mounted in the lower portion of the tubular housing 46 is a lower bearing support plate 50 having a bearing 51 mounted thereon and an upper bearing plate 52 having a bearing 53 mounted thereon. An eccentric weight-supporting shaft 54 is rotatably journaled in the bearings 51 and 53 and has an arm 58 affixed to the end thereof supporting an eccentric or unbalance weight 55. An upper eccentric or unbalance weight 56 is mounted at the other end of the shaft 54 on an arm 57 affixed to the shaft.

A motor 59 is mounted by means of a sliding base 60 and mounting plate 61 on the outer surface of the tubular housing 46 at the lower end thereof. The motor shaft 30 has a pulley 62 affixed thereto which is operatively connected to a pulley 63 mounted on the shaft 54 by means of an endless flexible belt 64.

Figure 3:
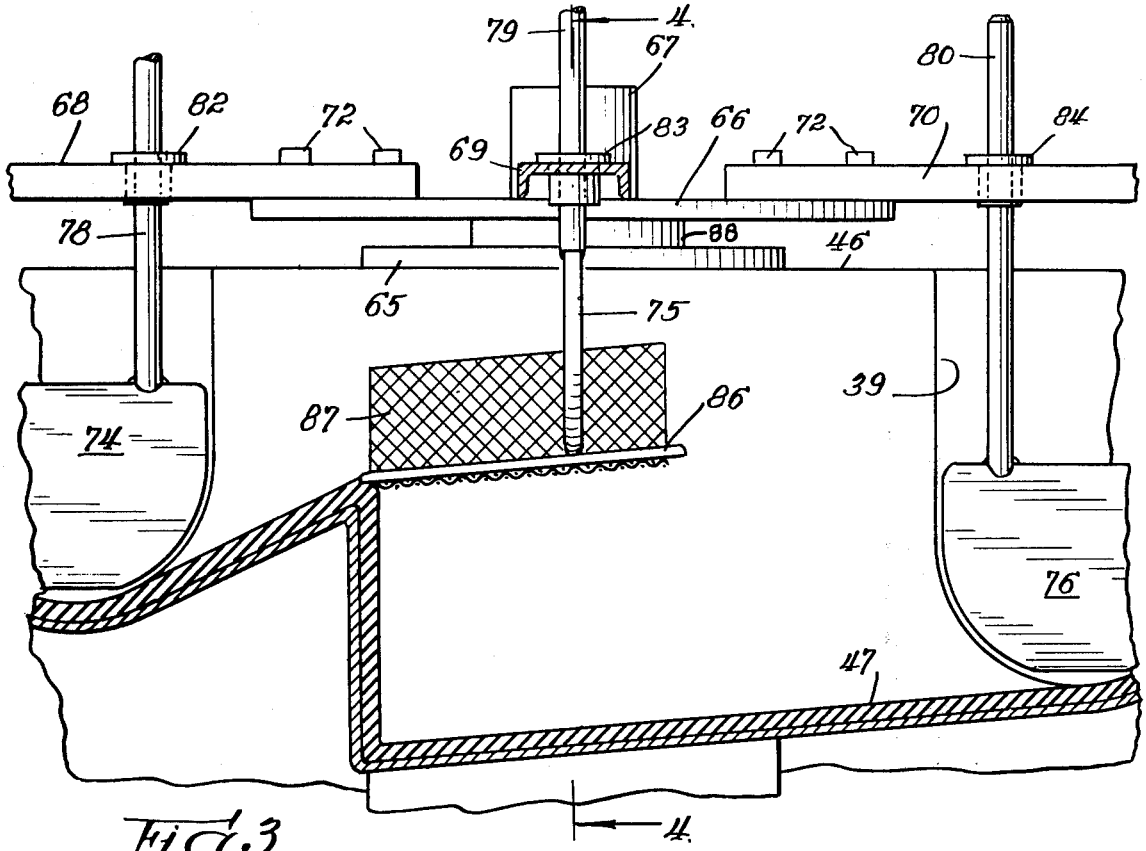
FIG. 3 is a fragmentary sectional view taken at the line 3—3 of FIG. 2, looking in the direction of the arrows.
Figure 4:
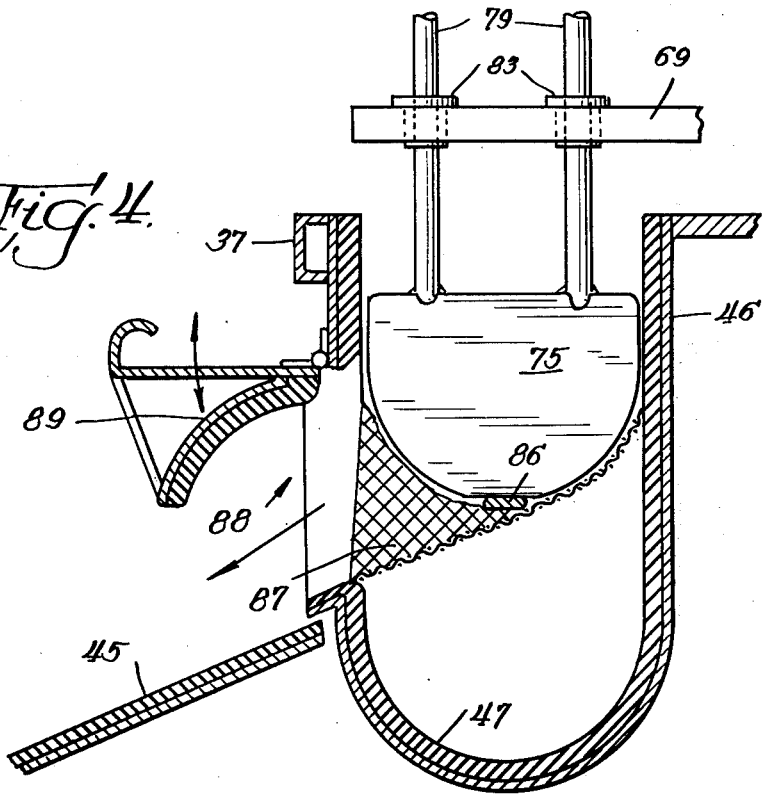
FIG. 4 is a fragmentary cross-sectional view taken at the line 4—4 of FIG. 3, looking in the direction of the arrows.

The structure for defining compartments movable with respect to the finishing chamber is shown in FIGS. 1–4 and in greater detail in FIGS. 3 and 4. The structure comprises a pedestal 65 mounted on the cylindrical support 46 and having a vertical spindle and a bearing 88 mounted thereover. A turntable 66 is rotatably mounted on the spindle. A cap 67 affixed to the turntable is journaled over the spindle. Radial arms 68, 69, 70, and 71 are mounted on the turntable 66 by means of bolts 72. Additional holes 73 are provided for mounting additional radial arms or for repositioning the existing radial arms. Partitions or separators 74, 75, 76, and 77 are provided with vertical guide rods 78, 79, 80, and 81, the partitions being affixed to one end of the rods. Bushings 82, 83, 84, and 85 slidably receive the rods 78, 79, 80, and 81, respectively. Although not absolutely necessary, a rail 86 (FIG. 4) may be provided to guide the partitions 74–77 along the bottom of the finishing trough and over the separating screen 87. Magnetic separator or vacuum separator means may be employed in place of foraminous member 87 if desired. An exit port 88 is provided for discharging finishing parts, and is maintained closed during the finishing operation by means of a door 89 and throughout as many recycles of the finishing operation as may be desired. An exit trough 45 may be utilized to guide discharged parts to a suitable receptacle or assembly line (not shown).

In placing the embodiment of FIGS. 1–4 into operation, the finishing material is loaded into the finishing chamber 39. The parts are then loaded into the finishing chamber, one or more parts being placed in each compartment intermediate each pair of partitions, for example in the compartment between 75 and 76. Additional parts may be placed one in each of the remaining compartments. The electric motor 59 is then activated, causing the finishing chamber to undergo gyratory motion, and thereby causing the parts and finishing material to engage in orbital motion in the arcuate chamber, and additionally to undergo precession upwardly in a circumferential direction along the trough of the finishing chamber. Since the partitions 74–77 are supported on a freely rotating turntable, they revolve passively in the chamber together with the parts, maintaining each part separated from every other part, thereby preventing damage by collision. The lower arcuate portions of the partitions ride on the bottom of the trough, and where a rail 86 is utilized, on the rail itself. As the partitions proceed along the inclined bottom of the trough, they are elevated, the vertical guide rods 78, 79, 80, and 81 rising within the inserts, thereby guiding the partitions radially and longitudinally while permitting them to rise vertically. When the partitions rise to the uppermost portion of the finishing chamber and clear the screen 87 and the vertical wall 43, they are then permitted to drop to the lower portion 41 of the trough under the influence of gravity. The parts proceed through one or more finishing cycles, as desired, and are then discharged through the discharge exit and fresh parts are loaded into the empty compartments. The separated media drops through the screen for reuse in another cycle. The operation is the same regardless of the exact type of separating means employed.

Figure 5:
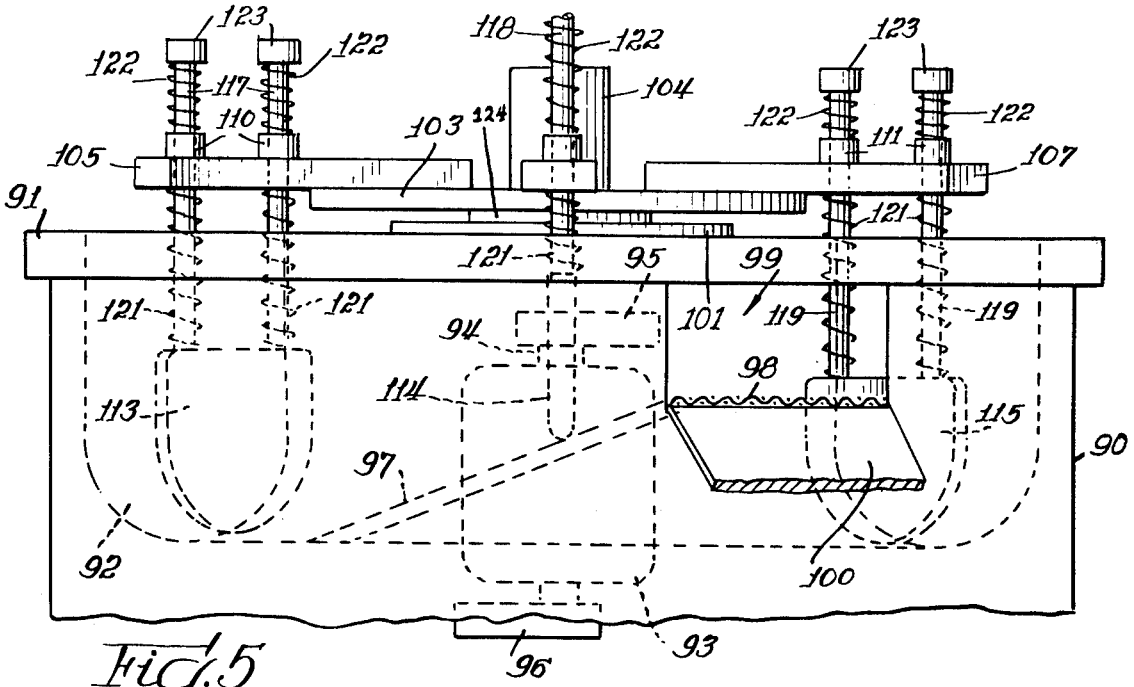
FIG. 5 is a fragmentary elevational view of another embodiment of the invention.
Figure 6:
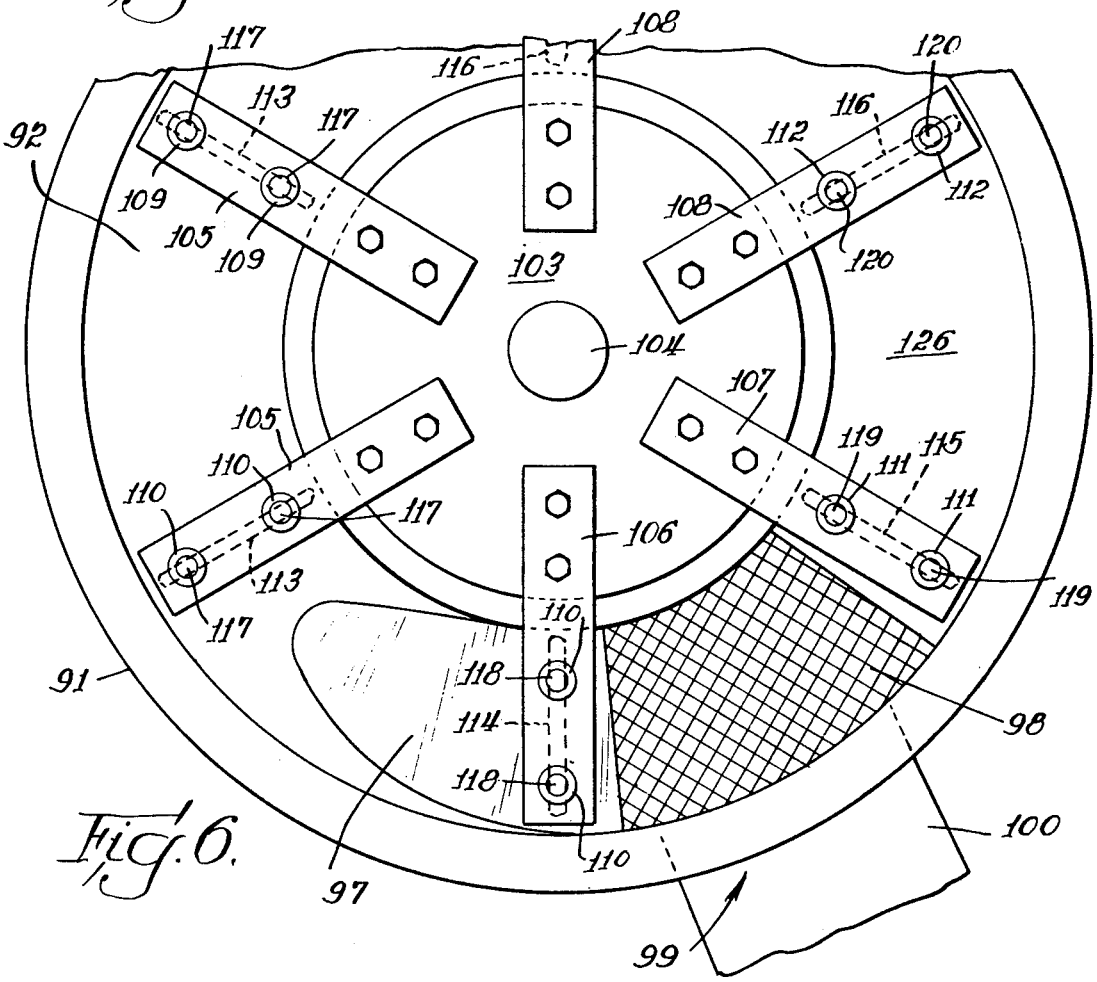
FIG. 6 is a fragmentary top plan view of the apparatus shown in FIG. 5.

Referring to FIGS. 5 and 6, another embodiment of the invention is shown. A portion of the structure is basically the same as that shown in FIGS. 1–4, and therefore only the structural portion which is different is shown. In addition to the structure shown in FIGS. 1–4, the structure of FIGS. 5 and 6 comprises a finishing chamber support 90 having a channel-type rim 91 and an annular finishing chamber 92 having a horizontal bottom. A motor 93 is supported by a portion of the finishing chamber support (not shown) and is provided with a shaft 94 having eccentric or unbalance weights 95 and 96 affixed to the ends thereof. In order to discharge parts, a ramp 97 is provided terminating in a separation screen 98 leading to an exit port 99 and an exit trough 100. Although not shown, a door similar to that shown in FIG. 4 may be utilized to close the exit port during operation.

The means for isolating parts during the finishing process comprises a pedestal 101 affixed to the floating frame of the finishing apparatus (not shown). The pedestal is provided with a vertical spindle (not shown) affixed thereto over which is mounted a bearing 124 and a turntable 103. A cup 104 affixed to the turntable 103 is journaled over the spindle. Affixed to the turntable 103 are radial arms 105, 106, 107, and 108 by means of bolts. Bushings 109, 110, 111 and 112 are mounted on the radial arms. Partitions 113, 114, 115 and 116 are provided with vertical guide rods 117, 118, 119 and 120, respectively, affixed at their ends to the partitions, and are in turn slidably journaled through the respective bushings 109, 110, 111 and 112. The vertical guide rods 117, 118, 119 and 120 are provided with lower biasing springs 121 and upper biasing springs 122. Caps 123 screwingly engage the vertical guide rods and retain the upper biasing.

In operation, parts and finishing material are charged into the finishing chamber in the portion shown on the right-hand side of FIGS. 5 and 6. The motor is caused to rotate causing gyratory motion which causes the parts and finishing material to vibrate with an orbital motion and additionally to proceed counter-clockwise as shown in FIG. 6. Each part is placed in a compartment 125 defined by the partitions 113 and 114 and in the compartment 126 defined by the partitions 115 and 116. The precessional movement of each part and media pushes against the partition in front of it and causes the turntable to rotate with the parts, thereby maintaining the parts in their individual compartments as they proceed during the finishing process. When they reach the ramp 97, the parts and finishing material rise along the ramp onto the screen 98. Here the finishing material passes through the screen and continues its travel along the finishing chamber while the part is discharged through the exit port 99 into the exit trough 100. When each partition reaches the ramp the springs 121 are compressed and the springs 122 permitted to extend, permitting the partitions to rise up the ramp and onto the screen. After the partitions pass the screen, they drop again to the bottom of the trough and are maintained there by the force of the lower springs 121. The upper springs 122 are provided to counter balance the lower springs 121 so that the partitions have an equilibrium point at or near their position at the bottom of the trough.

Figure 7:
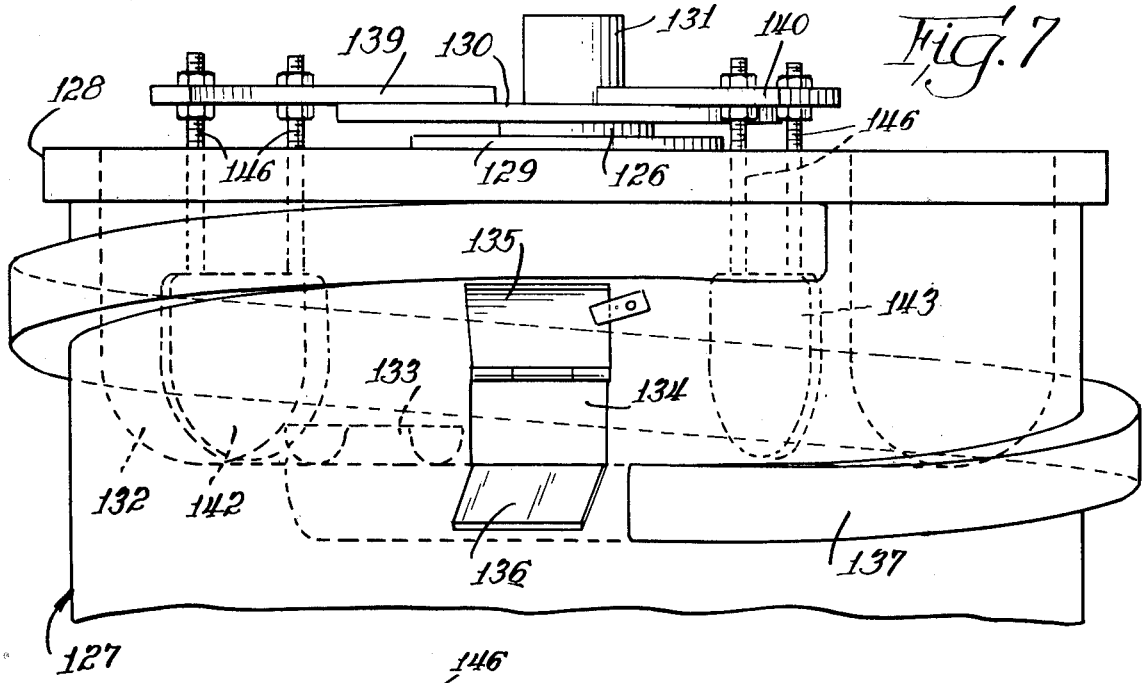
FIG. 7 is a fragmentary side elevational view of another embodiment of the invention.
Figure 8:
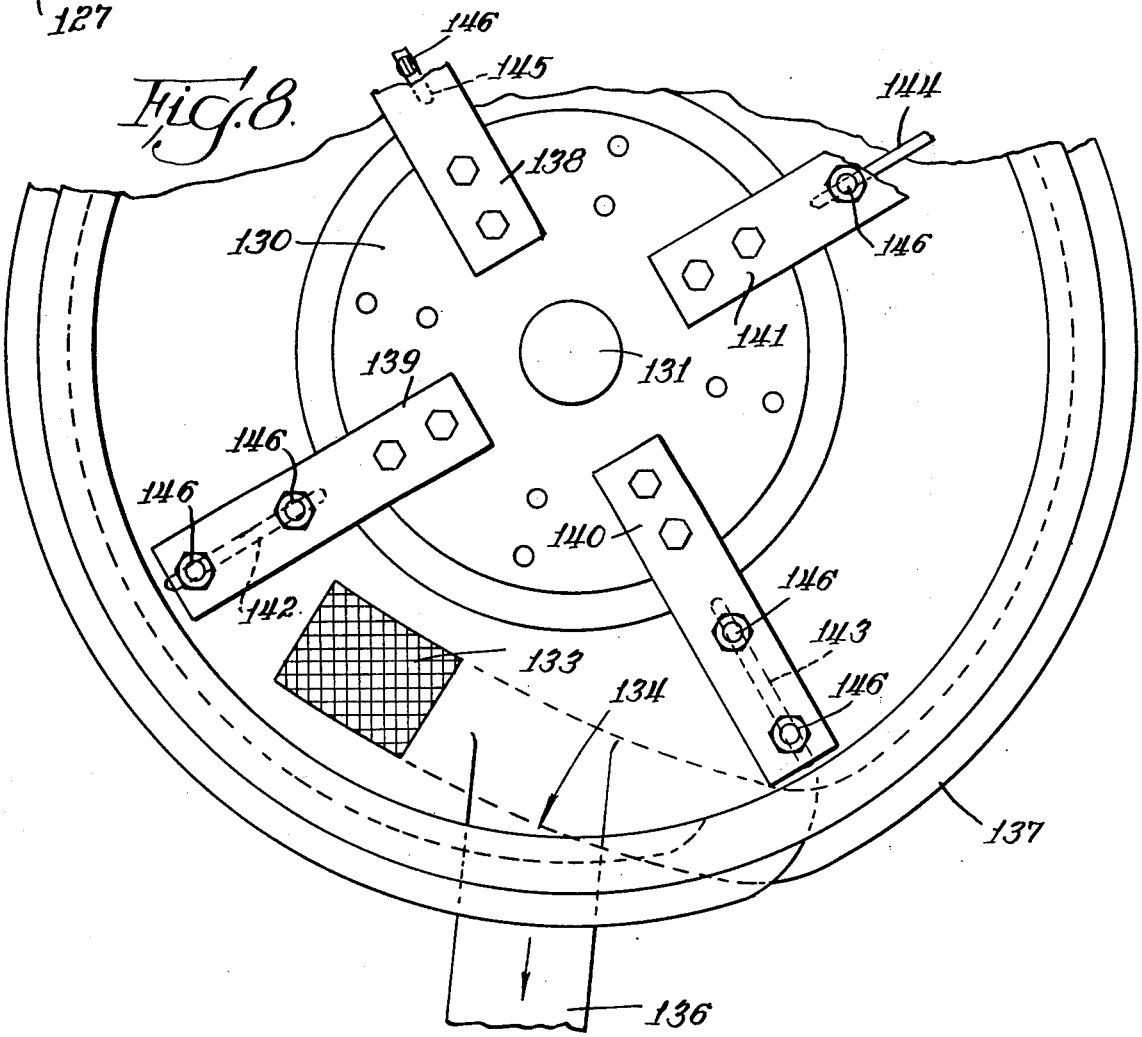
FIG. 8 is a fragmentary top plan view of the embodiment shown in FIG. 7.

Referring to FIGS. 7 and 8, still another embodiment is shown. The apparatus is provided with a chamber-supporting frame 127 mounted and vibrated by equipment similar to that shown in FIGS. 5 and 6, and having a rim 128. The part-isolating structure is similar to that shown in the previous figures, and comprises a pedestal 129 supported on the frame 127 having a vertical spindle similar to that shown in the previous drawings but not shown. A bearing 126 is mounted on the spindle and over the bearing is mounted a turntable 130 having a cap 131 journaled over the spindle. The annular finishing chamber 132 has a horizontal bottom with a trough-form screen 133 for separating finishing material. The chamber 132 is provided with an exit port 134 to discharge parts which is closed by a door 135 during the finishing operation. The separated parts are discharged through the exit port onto the exit ramp 136, and the finishing media which passes through the screen 133 is returned along a media return tube 137 back to the finishing chamber.

The compartmentalization structure comprises radial arms 138, 139, 140 and 141 affixed by bolts to the turntable 130. Part-isolating partitions 142, 143, 144 and 145 are affixed to vertical guide rods 146 which are in turn bolted to the radial arms 138, 139, 140 and 141 by means of bolts. Because the bottom of the finishing trough 132 is horizontal and has no ramp, the partitions undergo no vertical motion, and therefore the vertical guide rods 146 are permanently affixed to the radial arms by screw nuts.

In the embodiment of FIGS. 7 and 8, the finishing process proceeds as that described above with respect to the apparatus of FIGS. 5 and 6, the partitions forming compartments around each part so that it cannot collide with an adjacent part. When the finishing process is complete, the door 135 is opened, discharging the parts, the finishing material is returned through the material return tube 137 and the partitions continue to revolve. Alternatively, any of a number of known external auxiliary conveyors and separators may be utilized to separate the finishing material and return it to the starting or loading portion of the chamber.

Figure 9:
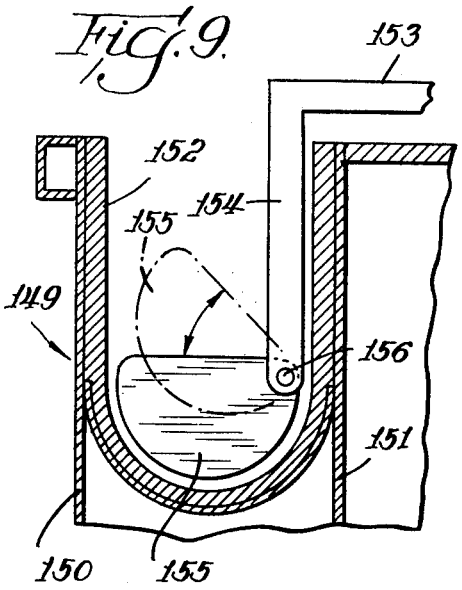
FIG. 9 is a fragmentary cross-sectional view showing an alternative means for raising the partitions of the present invention.

Referring to FIG. 9, a modified form of part-isolating apparatus is shown, mounted in a finishing machine 149 having walls 150 and 151 supporting a finishing chamber 152 in the form of an annular trough. The portion of the apparatus shown comprises a turntable 153 rotatably mounted similarly to that shown in the previous figures having a plurality of vertical supporting arms 154 affixed at one end to the turntable and extending into the finishing chamber 152. Semi-circular partitions 155 are pivotally mounted to the lower end of the supporting arm 154 by conventional means such as rivets 156. During the finishing process adjacent partitions define compartments in each of which a part to be finished is placed. As the parts and finishing material are caused to proceed along the trough, they engage and push the partitions 155 and cause them to move with the part, thereby maintaining the part isolated from other parts throughout the finishing process. If a ramp and separating screen is used, the partition pivots upwardly to clear the ramp while still maintaining the parts separated. When the ramp is cleared, the partition pivots downwardly to engage the bottom of the trough again.

Figure 10:
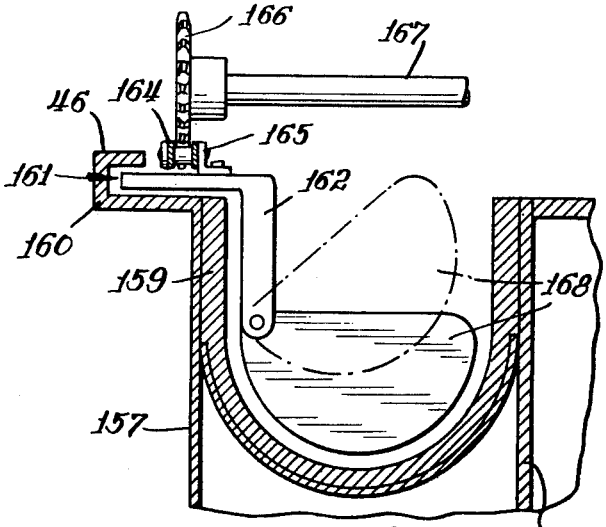
FIG. 10 is a fragmentary cross-sectional view showing still another embodiment utilized for raising and supporting the partitions of the present invention.

FIG. 10 illustrates a portion of a finishing apparatus having supporting walls 157 and 158 and an annular finishing chamber 159. At the rim of the supporting wall 57 a J-form flange 160 is provided defining a slot 161. An L-shaped supporting arm 162 has a horizontal arm slidably positioned in the slot. A chain 164 is affixed to the horizontal arm by means of a corner mounting bracket 165. The chain is coupled to a sprocket 166 mounted on a shaft 167. Partitions 168 are pivotally connected to the vertical portion of the arm 162.

In operation the basic portion of the finishing machine operates in similar manner as described with regard to the previous embodiment. The apparatus for maintaining the parts separated may be utilized in one of several different procedures. In one embodiment, the sprocket may be free-running, or even omitted, the chain then serving solely to support the partitions for movement. In this method the movement of the parts drives the partitions along at the same rate of precession as the parts while still maintaining the parts separated. In still another method of operation, the sprocket may be coupled to a control such as a solenoid or ratchet which either retards the sprocket or else stops it completely at the desired positions or time intervals, thereby providing additional control of the finishing process. Further, all methods may be made available by combining the motor, stopping means or retarding means in the same apparatus.

Figure 11:
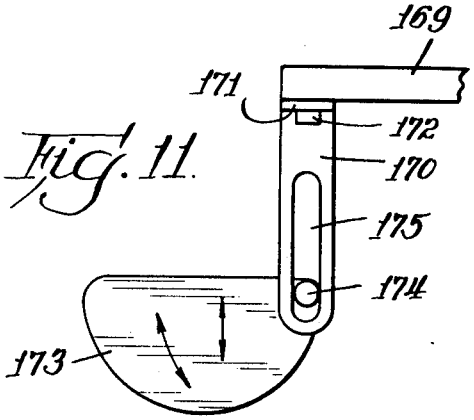
FIG. 11 is a fragmentary view of another embodiment of the invention showing a partition and supporting member.
Figure 12:
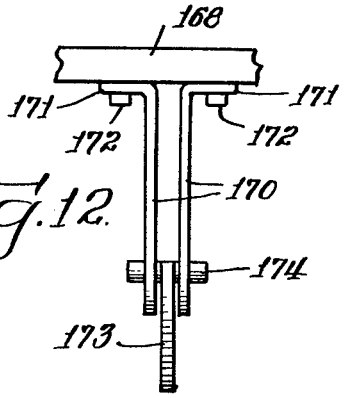
FIG. 12 is an elevational view taken at the line 12—12 of FIG. 11, looking in the direction of the arrows.

FIGS. 11 and 12 illustrate a portion of a part-isolating apparatus comprising a turntable 169 and a vertical support comprised of a pair of spaced-apart vertical arms 170 affixed to the turntable by means of feet 171 secured by bolts 172. A partition 173 is mounted on the vertical arm by means of a pin 174 affixed to one corner of the partition and riding in slots 175 provided in the vertical arms 170. The structure permits the partitions to rise, fall, or pivot when encountering any obstruction such as ramp or discharge mechanism.

Figure 13:
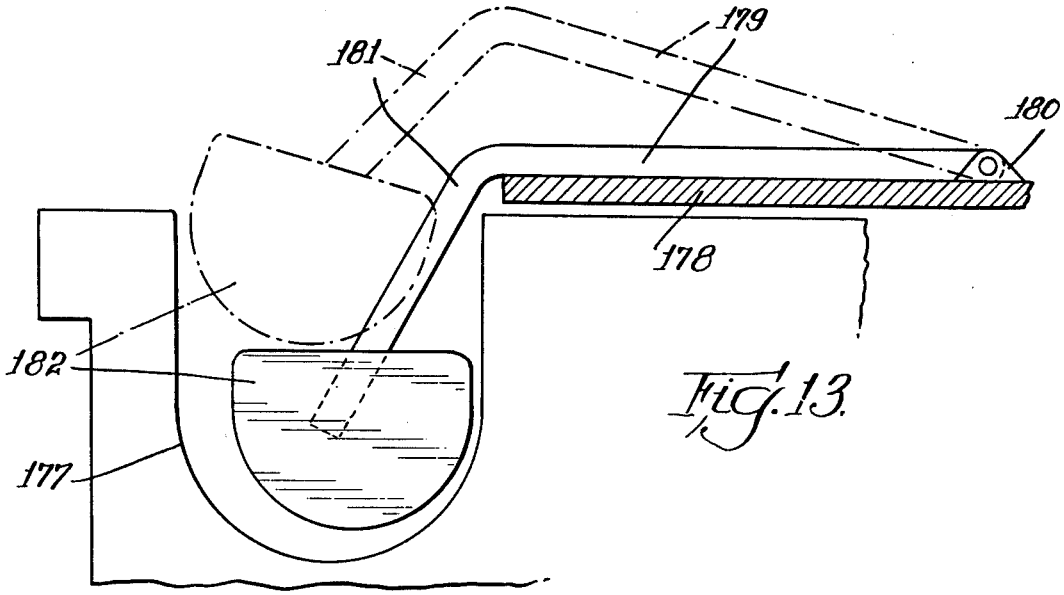
FIG. 13 is a fragmentary sectional view showing still another embodiment of the invention.

FIG. 13 illustrates an annular finishing trough 177 in conjunction with which is mounted a turntable 178 having a horizontal arm 179 pivotally mounted thereto by means of supporting ears 180 and a pivot pin. The horizontal arm 179 is provided with an offset end 181 which is affixed at its end to a partition 182. The structure is so arranged that when a ramp or other obstruction is encountered, the partition and its supporting structure are raised to clear the ramp or obstruction.

FIGS. 14–17 illustrate a further embodiment of the invention. The apparatus shown in part comprises a support 184 having a helical annular finishing chamber 185 mounted thereon. The finishing chamber is provided with an exit port 186 which may be closed by a door during operation and a media separating screen 187 mounted in the chamber and terminating at the port 186. The apparatus for providing moving compartments to isolate the parts comprises an outer U-form track 188 and an inner U-form track 189. A plurality of partitions 192 are mounted in the trough comprising sheet-form members each having an arcuate bottom and a transverse supporting rod 193 affixed to the upper edge thereof, the rods connected at their ends by means of fillets 194 to longitudinal guide rods 195 and 196. The longitudinal guide rods 195 and 196 are preferably made of a flexible material such as nylon or other flexible plastic materials, or materials such as spring metal, so that they can slide well and bend around curved portions of the track.

Figure 14:
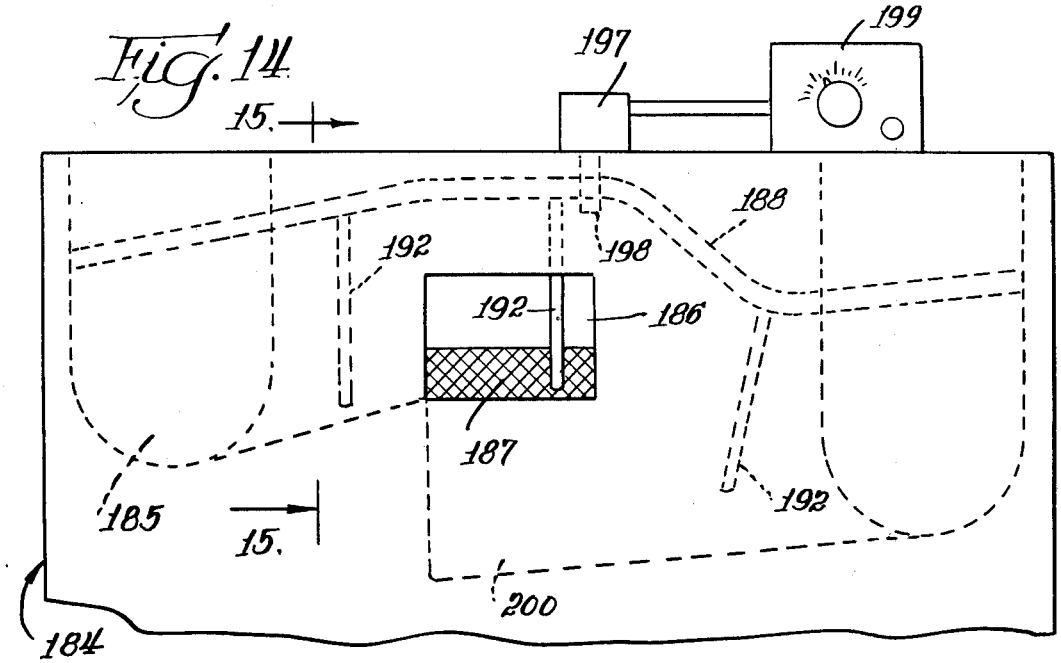
FIG. 14 is a side elevational view of another embodiment of the invention.
Figure 15:
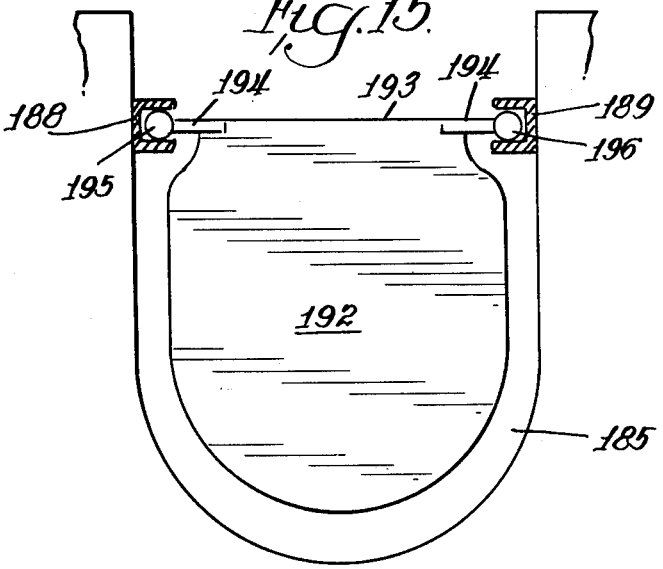
FIG. 15 is a cross-sectional view taken at the line 15—15 of FIG. 14, looking in the direction of the arrows.
Figure 16:
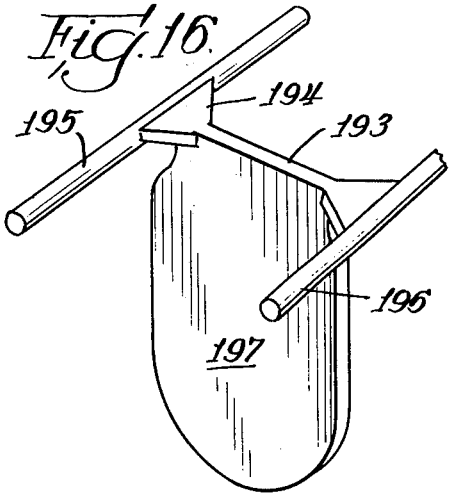
FIG. 16 is a perspective of the partition utilized in the embodiment of FIGS. 14 and 15.
Figure 17:
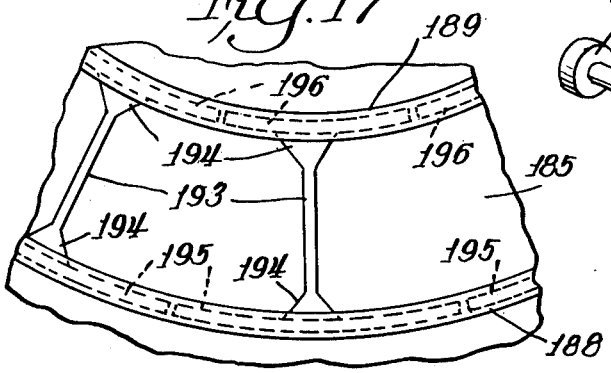
FIG. 17 is a fragmentary top plan view of the embodiment shown in FIGS. 14–16.

As shown in FIG. 14, additional apparatus is provided for stopping the longitudinal precession of the separating partitions, and therefore also the parts at any desired point. The apparatus comprises a solenoid 197 having an operating pin 198 arranged to be depressed on signal to stop a partition for any desired time. The operation is timed by a timer 199.

In operation the gyrational movement of the finishing machine causes the parts and the partitions defining the compartments to move along in a forward direction. Timing of the process may be accomplished by stopping precession by means of the solenoid 197 for any desired period. The parts and partitions then continue to move when released until the solenoid is actuated again. When the parts and finishing material reach the screen 187 the finishing material is separated and falls to the beginning or lower portion 200 of the finishing chamber to begin a new cycle, and the parts are discharged through the exit 186.

Figure 18:
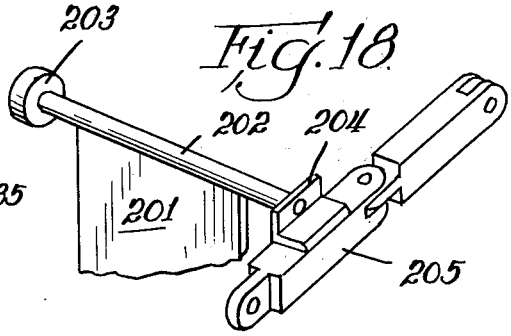
FIG. 18 is a fragmentary perspective view of another embodiment of the invention.

FIG. 18 shows a modified embodiment for supporting partitions 201 and comprises a transverse supporting rod 202 having a roller 203 mounted at one end and being affixed at the other end by a right angle bracket 204 to a universal chain 205. The chain may be engaged in a guiding track (not shown).

Figure 19:
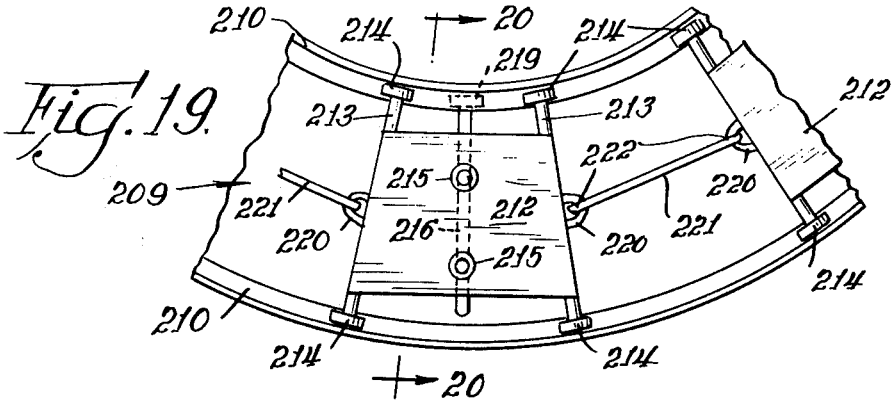
FIG. 19 is a fragmentary plan view of still another embodiment of the invention.
Figure 20:
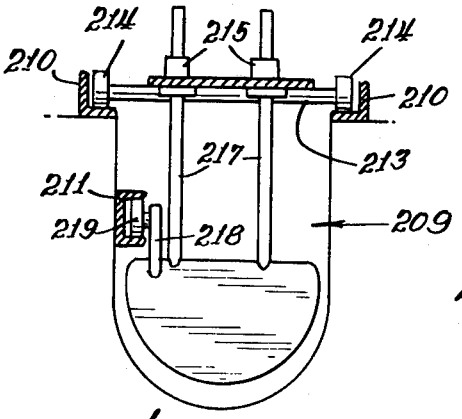
FIG. 20 is a cross-sectional view taken at the line 20—20 of FIG. 19, looking in the direction of the arrows.

In the embodiment shown in FIGS. 19 and 20 the finishing chamber 209 is provided with tracks 210 mounted at its lips, and a partition guiding track 211 at a midportion of its wall. A car frame 212 is provided with axles 213 having wheels 214 at their ends engaged in the tracks 210. A pair of guides 215 are mounted on the car frame. A sheet-form partition 216 is disposed within the trough of the finishing chamber and supported by vertical guide rods 217 affixed at one end thereto and slidably engaged in the guides 215. A lift rod 218 is also affixed to the partition 216 and is provided with a roller 219 engaged in the track 211. The cars are connected to each other by means of terminal eyes 220 connected to adjacent cars by means of connecting links 221 having loops 222 at their ends engaging the eyes 220. The track 211 is positioned to raise the partition to clear ramps and inclines.

Figure 21:
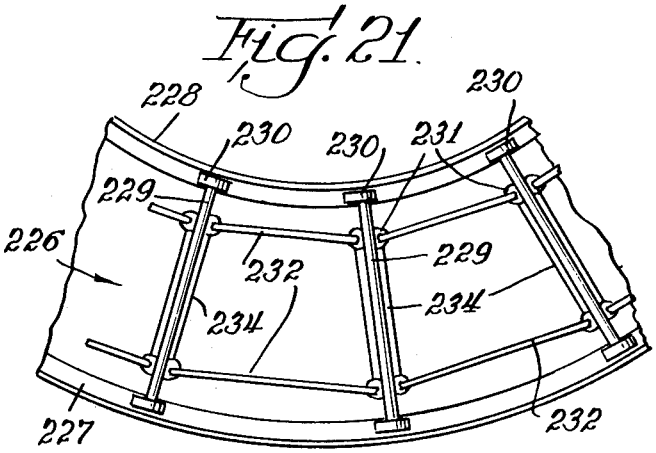
FIG. 21 is a fragmentary plan view of still another embodiment of the invention.

FIG. 21 shows an embodiment somewhat modified from that shown in FIGS. 19 and 20 comprising a finishing chamber 226 having an outer track 227 and an inner track 228. Axles 229 support partitions 234. Eyes 231 are provided on the axles 229 and are engaged by connecting links 232 having loops at their ends engaging the eyes 231. The general operation of the structure is much the same as that of the embodiment shown in FIGS. 19 and 20.

Figure 22:
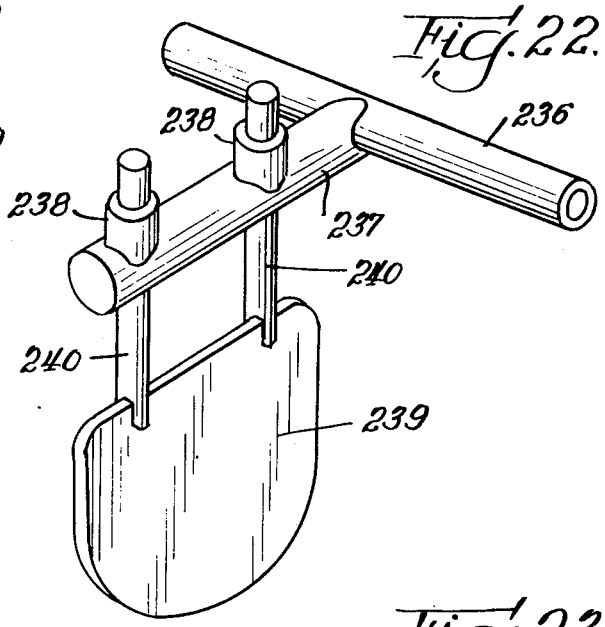
FIG. 22 is a perspective view of a partition and support of still another embodiment of the invention.

FIG. 22 illustrates a modified means of supporting the partitions. In this embodiment a longitudinal horizontal tubular support 236 is provided which may engage a rod or wire mounted at the side of the finishing chamber. Alternatively, it may be mounted over the connecting links 232 of FIG. 21. Affixed to the tubular support 236 is a transverse supporting arm 237 which is provided with inserts 238. The partition 239 is provided with vertical guide rods 240 which are slidably engaged in the inserts 238. When a ramp or obstacles are encountered the structure is free to rise vertically with the guide rods 240 sliding upwardly within the inserts 238. Alternatively, the structure may pivot about the tubular support 236 to avoid obstructions. The tube 236 may be provided with a longitudinal slot to clear supporting structures.

Figure 23:
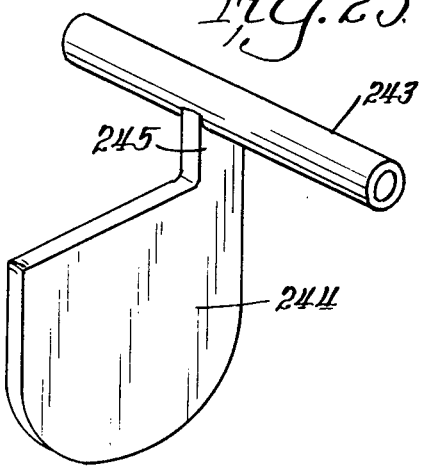
FIG. 23 is a perspective view showing a partition and support of still another embodiment of the invention.

FIG. 23 illustrates an embodiment having a horizontal tubular support 243 to which a partition 244 is affixed by means of a mounting tab 245 which is affixed to the support 243. As in the structure of FIG. 22, the tube 243 is mounted either on a rod or a wire or on a wire support such as 232 of FIG. 21, on which it may slide or rotate. Alternatively, it may be mounted on a hinge pin of a cart which may ride in a track provided at one side of the finishing chamber. When a ramp or any other obstacle is encountered, the partition 244 pivots about the axis of the tubular support 243 sufficiently to clear such objects.

Figure 24:
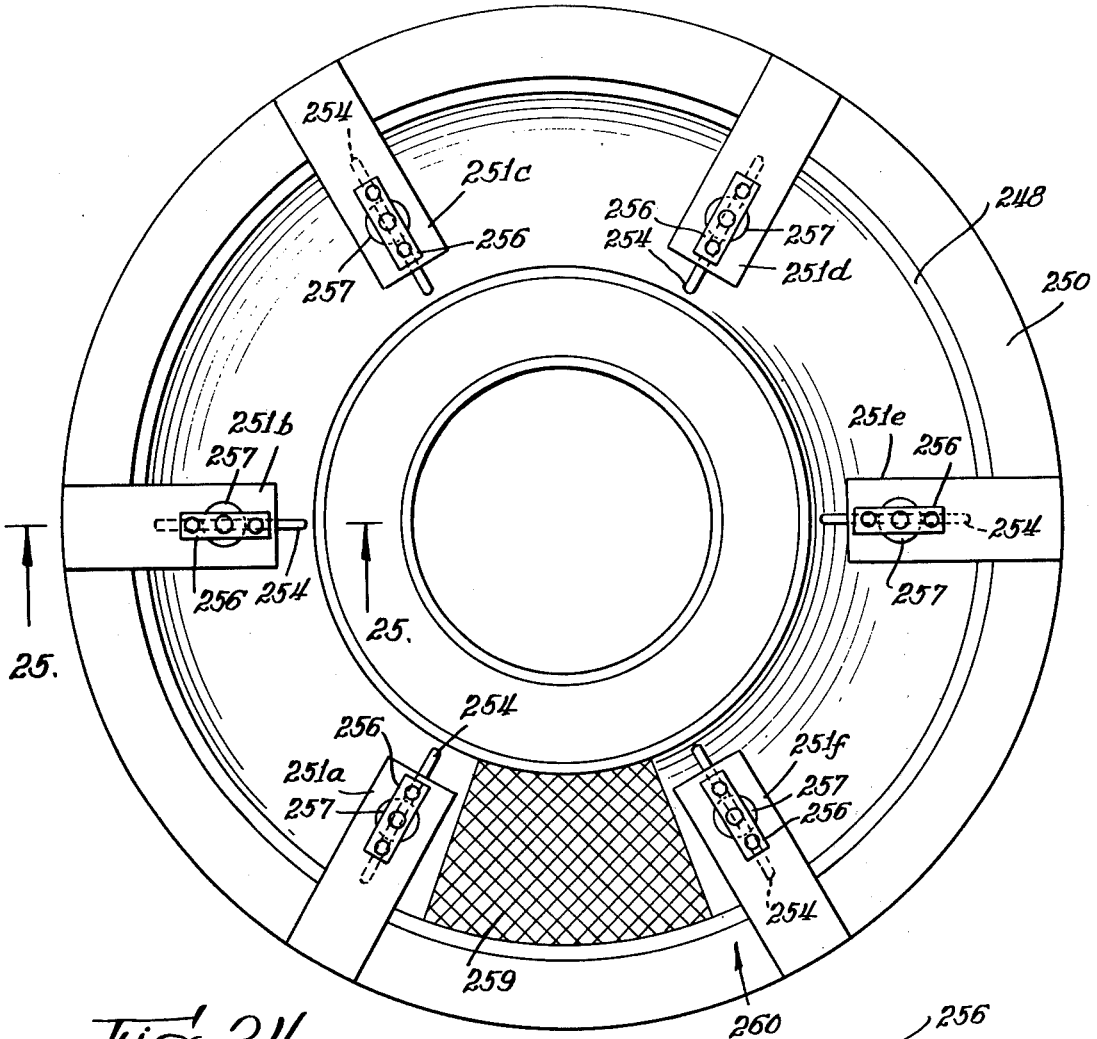
FIG. 24 is a top plan view of a further embodiment of the invention.
Figure 25:
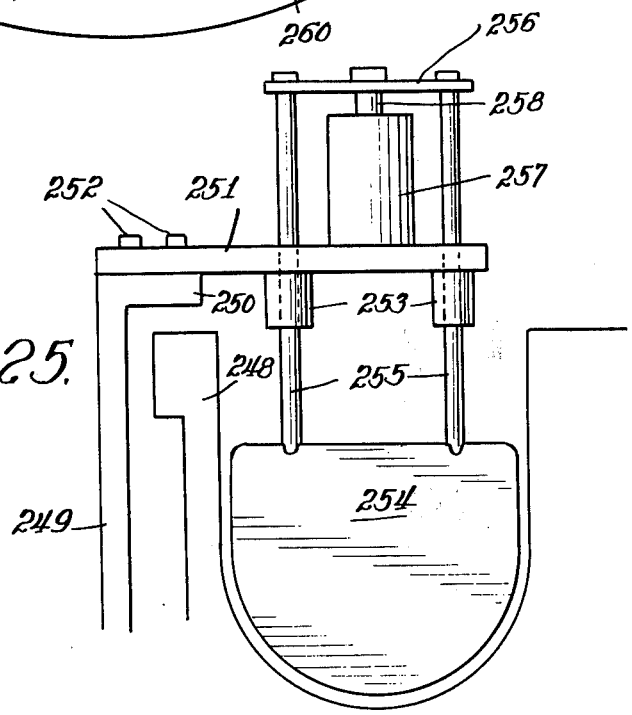
FIG. 25 is a fragmentary cross-sectional view taken at the line 25—25 of FIG. 24, looking in the direction of the arrows.

FIGS. 24 and 25 illustrate still a further embodiment of the invention using a somewhat modified principle. Whereas in the embodiments previously described, the partitions move longitudinally along the finishing chamber, in this embodiment the partitions move vertically with respect to the chamber, although the compartments themselves in effect move longitudinally. The result is that although the parts and finishing material are free to move longitudinally at predetermined periods when the partitions are lifted, they are still always isolated from adjacent parts by closed partitions. In effect the chamber in which the part is positioned moves from one set of adjacent partitions to another set of adjacent partitions.

Referring to FIGS. 24 and 25, an annular finishing chamber 248 is shown which may be supported on any type of gyratory finishing apparatus shown in the previous drawings. Mounted outside of the finishing chamber 248 is an outer wall 249 having a horizontal flange 250 at its upper edge. A plurality of horizontal supporting arms 251*a*, 251*b*, 251*c*, 251*d*, 251*e* and 251*f* are affixed to the flange 250 by means of bolts 252. Tubular inserts 253 are affixed to the supporting arms. The partitions 254 are affixed to the ends of vertical guide rods 255 which are slidably positioned within the inserts 253. The upper ends of the guide rods 255 are connected by means of a connecting plate 256 bolted thereto. A solenoid 257 is mounted on the supporting arm 251 and has an operating rod 258 which engages the connecting plate 256. Further, as shown in FIG. 24, the finishing chamber is provided with a separating screen 259 and an exit port 260.

The apparatus shown in FIGS. 24 and 25 may be operated in any of several ways. In one method of operation, parts are placed in every one of the compartments between the partitions except one, that is, the screen compartment having the exit port between vertical partitions A and F. As the machine is operated there is a tendency for the parts and finishing material to proceed longitudinally along the finishing trough in conventional fashion. However, when the partitions are all closed, they prevent the parts from proceeding along the trough. After the parts in the compartment between partitions on arms 251*a* and 251*b* are finished, the solenoid at the 251*a* partition is actuated and the partition is raised, permitting the part to go from the compartment 251*a*–251*b* to the compartment 251*b*–251*f* where it is discharged. The partition at 251*a* is then closed. With the compartment 251*c*–251*b* now empty, the partition 251*b* is raised permitting the next part to proceed from compartment 251*b*–251*c* to compartment 251*a*–251*b*, and the partition at 251*b* is closed. The partition at 251*c* is then raised to permit transfer of the succeeding part from compartment 251*c*–251*d* to compartment 251*b*–251*c* and the partition closed. Then the partition at 251*b* is raised to permit the parts in the compartment at 251*d*–251*e* to proceed to the compartment at 251*c*–251*d* and the partition is closed. Finally the partition at 251*e* is raised permitting the newly inserted part to proceed from the compartment 251*e*–251*f* to the compartment 251*d*–251*e*. This leaves the compartment 251*e*–251*f* open and a new part may be inserted therein and the finishing cycle continued.

In another method of operation parts are placed in alternate compartments, for example, in compartment 251*a*–251*b*, compartment 251*c*–251*d* and compartment 251*e*–251*f*. During the finishing process the parts are maintained stationary with respect to precession. When it is desired to permit the parts to move into the following compartments, alternate partitions for example 251*a*, 251*c*, and 251*e* are opened permitting each part to progress into the succeeding compartment. Subsequently, at the proper time, partition 251*b*, 251*d*, and 251*f* are open permitting a further advance into succeeding compartments. This continues until all the parts are finished and discharged through the exit port 260. If desired the exit port may be closed and the process continued for a plurality of cycles until adequate finishing has occurred.

The methods described for use with the apparatus shown in FIGS. 24 and 25 permit precise timing of each part resulting in high precision finishing. Moreover, since the parts remain in individual compartments at all times, there is no danger of damage to the parts by collision with adjacent parts.

In the embodiment shown in FIGS. 24 and 25, the partitions may be mounted on a non-vibrating portion of the apparatus to simplify the structure and prevent damage or excessive wear due to vibration.

Figure 26:
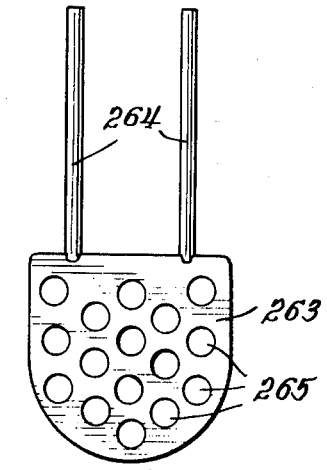
FIG. 26 is a side elevational view of an embodiment in which the partition is foraminous.

FIGS. 26–30 illustrate various types of partition structures. In FIG. 26 a foraminous partition 263 is shown having vertical guide rods 264 and apertures 265. The partition operates in much the same way as those described previously. However, although the partition retains the parts and prevents them from contacting one another, it permits the finishing material to pass through the partition, thereby preventing unduly great accumulation of the finishing material in any compartment.

Figure 27:
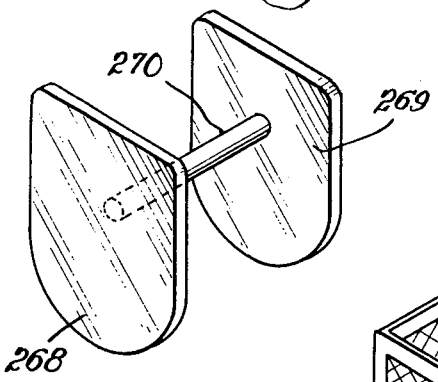
FIG. 27 is a perspective view of a pair of spaced-apart partitions of still another embodiment of the invention.

FIG. 27 illustrates a partition structure which does not require suspension of any type. The structure comprises a pair of spaced-apart partitions 268 and 269 connected by a supporting arm 270 in the form of a rod or tube or other related structures. The structure may be inserted in any conventional finishing chamber having an annular form and a trough with an arcuate bottom. The structure is self-supporting and slides along the finishing chamber with the parts, while isolating the parts. The parts may be placed intermediate the partitions 268 and 269, or alternatively may be placed between two complete partition assemblies.

Figure 28:
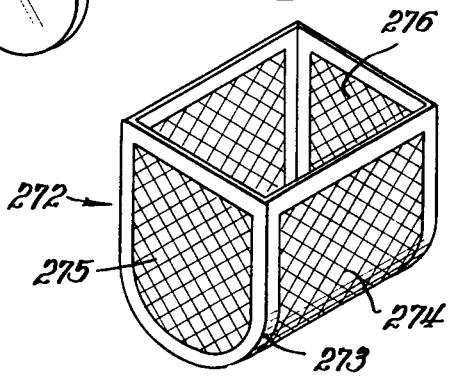
FIG. 28 is a perspective view of a basket-type structure having a pair of spaced-apart partitions.

FIG. 28 illustrates a basket-type partition assembly 272 comprising a frame 273, a U-form screen member 274 and a pair of spaced-apart partition screens 275 and 276. The screen material utilized may be formed of a plastic or rubber material or of metal coated with a protective material such as neoprene to prevent damage to the parts. In operation a single part may be placed in each basket-like assembly 272 and inserted into the finishing chamber. The part undergoes normal finishing as a result of abrasion by the finishing material which enters through the screen, and the part is kept isolated thereby from other parts to prevent damage. The basket slides along the chamber as a result of the gyratory motion and carries the part to the discharge portion of the apparatus where the basket together with the part may be discharged. Alternatively, the basket may be tipped to discharge the part.

Figure 29:
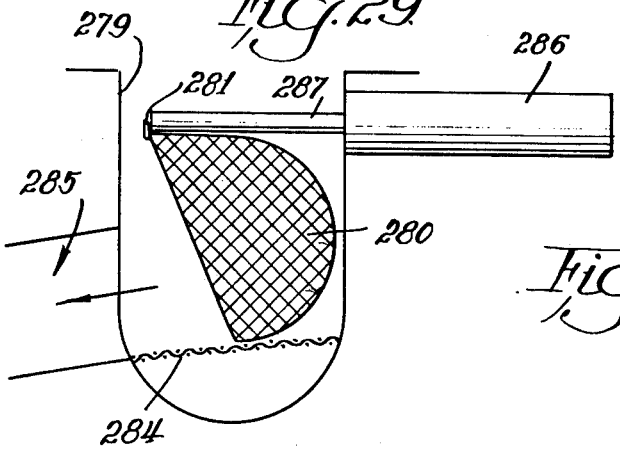
FIG. 29 is a fragmentary cross-sectional view showing a portion of a trough having a basket-type of compartment which is tilted over by mechanical means at the discharge station.
Figure 30:
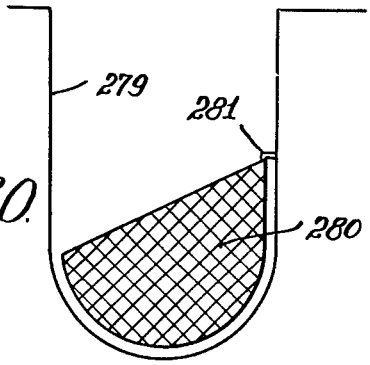
FIG. 30 is a fragmentary cross-sectional view of the embodiment shown in FIG. 29 but in a portion of the finishing chamber spaced along the chamber at a distance from the discharge cylinder.

FIGS. 29 and 30 illustrate the use of basket-type partition assemblies similar to that of FIG. 28. As shown in FIG. 29, a finishing chamber 279 is provided with a separation screen 284 and an exit port 285. A screen basket 280 similar to that shown in FIG. 28 is utilized to provide a compartment for individual parts. One edge of the basket is provided with a hook 281. As shown in FIG. 29, when the basket reaches the exit port 285, a solenoid or air cylinder 286 is actuated extending an operating rod 287 to engage the hook 281 and tilt the basket, thereby discharging the parts. After the exit ramp is cleared, the basket once again returns to its normal position in the finishing trough as shown in FIG. 30, and continues in the normal direction of precession.

Figure 32:
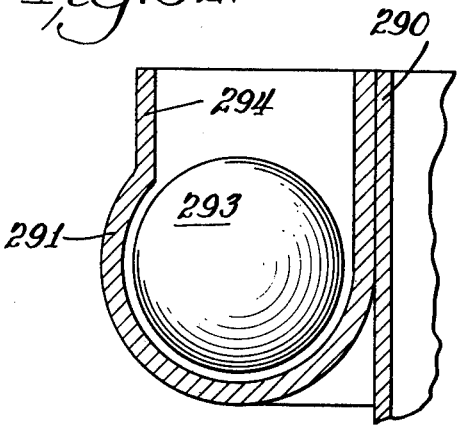
FIG. 32 is a fragmentary cross-sectional view taken at the line 32—32 of FIG. 31, looking in the direction of the arrows.
Figure 31:
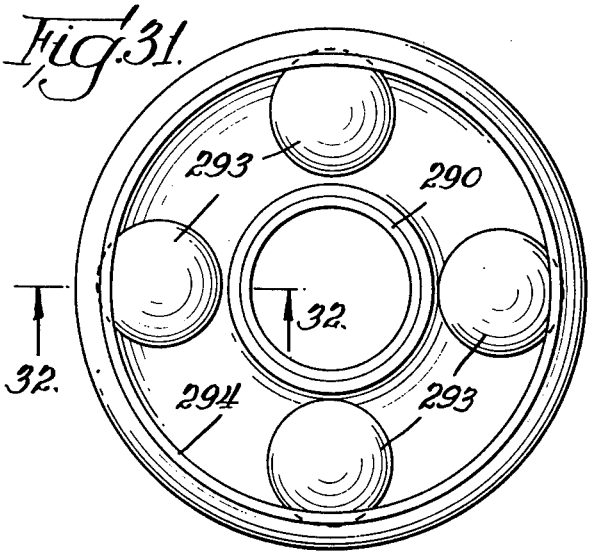
FIG. 31 is a top plan view of still another embodiment of the invention.

FIGS. 31 and 32 illustrate a further embodiment of the invention comprising a chamber support 290 having an annular finishing chamber 291 mounted thereon. The means for providing compartments to isolate the parts being finished comprise a plurality of balls or spheres 293 which are free to roll and travel with the parts and finishing material in the normal direction of precession. The balls are designed so that they substantially fill the chamber to prevent parts from passing around the balls, but are small enough to have freedom of movement. The outer rim 294 is sufficiently convoluted so the trough opening is smaller than the diameter of the balls, thereby preventing the balls from escaping during the finishing process. The balls may be made of rubber, either natural or artificial, various plastic materials, or of metal and covered by a material such as neoprene to prevent damage to the parts. When the parts are discharged through a conventional exit port, the balls are sufficiently large so that they clear the ramp and continue along the finishing chamber for a succeeding cycle.

In FIGS. 33 and 34, there is shown still another embodiment of the compartment-forming apparatus of the invention. In this embodiment a conventional annular finishing chamber 296 is shown having conventional supporting equipment. Mounted on the supporting equipment is a pedestal 297 having a vertical spindle 298. Mounted over the spindle are a bearing 301 of either sliding or frictionally retarding material and a turntable 299 having a cap 300 affixed thereto journaled over the spindle 298. The turntable 299 is provided with apertures 295. An axle 302 is affixed to the end of the turntable and is provided with a roller 303 which is engaged in a channel-form track 304. A vertical support 305 is mounted on the finishing apparatus and is provided with a horizontal arm 306. A track-support beam 307 is affixed to the end of the horizontal arm 306 and is provided with an outside track 308 and an inside track 309 affixed thereto. Roller supports 310 and 311 are affixed to the turntable and are provided with four pairs of concave rollers 312 and 313 mounted on shafts 314 and 315 retained in the roller supports 310 and 311. A partition 316 is supported by vertical guide rods 317 pivotally affixed thereto by hinge pins 318. The upper ends of the vertical guide rods 317 are provided with rollers 321 and 322 which engage the tracks 308 and 309.

During normal operation of the finishing machine, the turntable 299 rotates with its roller 303 engaged in the track 304. The tracks 308 and 309 may be so designed that the partitions are raised in order to clear inclined portions of the finishing chamber or discharge ramps. They may also be arranged to lower the partitions when the lower portion of the finishing chamber is reached. The concave rollers permit the vertical guides to raise and lower easily without bending.

FIG. 35 shows a modified structure for supporting the partitions. A finishing chamber 325 has a turntable 326 mounted thereover in manner described above. Affixed to apertures in the turntable are a plurality of springs 327. Partitions 328 have lugs 329 affixed thereto engaging the other ends of the coil springs 327. During operation the partitions are maintained in proper position at the bottom of the trough to separate adjacent parts. When an inclined portion of the finishing chamber or a ramp is encountered, the partition is bent rearwardly as shown in the drawing to permit the partition to clear the elevated structure.

FIG. 36 shows still another method of clearing an inclined portion of a finishing chamber or a ramp. In this structure a turntable 332 is provided with a partition 333 which is provided with a pin 334 engaging apertures in a pair of ears 335. Coil springs 336 are engaged by lugs 337 provided on the partition ends and lugs 338 provided on the turntable. When an incline or ramp or other obstruction is encountered, the partition is pushed rearwardly until it clears the obstruction, returning to its vertical position after the obstruction has been cleared.

FIG. 37 illustrates an embodiment wherein the turntable 341 is provided with a flexible partition 342 affixed to the turntable 341 by means of a retainer 343. The partition 342 may be fabricated from natural or synthetic rubber, various flexible plastic materials, or flexible metals which are preferably coated with an elastic material such as neoprene. During the finishing operation as the partition encounters an incline or ramp, the partition is bent rearwardly, raising its lower portion over the obstacle while still maintaining the parts isolated.

FIG. 38 illustrates a structure for controlling the speed of rotation of the turntable or for stopping it entirely at any desired point of time and for any desired period. Shown are a conventional finishing chamber support 346 and a turntable 347 rotatably mounted thereover. The periphery of the turntable is in the form of a ratchet 350 and a pawl 349 is pivotally mounted on the chamber support 346. A solenoid 348 is externally controlled and raises or lowers the pawl to control the rotation of the turntable.

FIG. 39 illustrates a finishing apparatus having a linear trough-form finishing chamber 352 having a motor 353 affixed thereto with eccentric weights 354 and 355. A pair of parallel spaced-apart chains 356 are mounted on a plurality of pairs of sprockets 357, 358, 359, 360 and 361. A plurality of partitions 362 are affixed at their upper edges to the chains in a manner similar to that shown in FIG. 41 below. A screen ramp 351 is provided for separating the finishing material and raising the parts to the discharge chute 372. In operation the motor 353 causes the finishing chamber to vibrate causing the parts and finishing material to move in an orbital path and to finish the surface of the parts. A single part is positioned in each compartment defined by a pair of partitions. The parts are loaded at the left-hand side of the apparatus shown in the drawing. Movement of the parts causes the partitions to move along at any desired speed and eventually parts push over the ramp 351 and into the discharge chute, the finishing material falling through the screen and remaining in the finishing trough. If desired the movement may be stopped during the finishing process for any desired period in order to completely finish the parts to the desired degree.

In a modified embodiment the partitions 362 may be mounted on a fixed support, and the finishing chamber 352 may be mounted on wheels or other means rendering the chamber linearly movable. Parts are placed in the compartments formed by the partitions and the apparatus vibrated. When finishing is completed, the apparatus is moved forward by any suitable means such as a motor or hydraulic cylinder. Since the partitions are fixed, they push the parts along the trough and eventually cause them to rise on the ramp 351 and to be discharged.

Referring to FIG. 40, a tumbling barrel-type of finishing machine is shown comprising a tumbling barrel 365 having rails 366 mounted thereon supported on rollers 367. A pair of sprockets 368 are mounted at one end and another pair of sprockets 369 are mounted at the other end on a shaft which in turn is connected to a motor (not shown). A pair of chains 370 are mounted on the sprockets and have a plurality of partitions 371 affixed to the chain at spaced intervals, in the manner similar to that shown in FIG. 41. In operation the barrel rotates in conventional form causing the parts and finishing material to tumble and to engage each other, thereby finishing the surfaces of the parts. Each part is individually placed in a compartment defined by a pair of adjacent partitions and thereby prevented from damaging each other by collision. During the finishing process the sprockets, chain and partitions may remain in fixed position if desired to increase the finishing period. When it is desired to discharge the parts, the motor may be started, causing the chain to move, whereupon the partitions push the parts out of the tumbling barrel.

FIG. 41 illustrates a tumbling apparatus comprising an endless tumbling belt 374 mounted on rollers 375 and 376. The parts and finishing material are placed in the trough formed by the upper flight of the belt 374. A motor causes the rollers to rotate, thereby causing the parts and finishing material to tumble. The part-isolating portion of the apparatus is similar to that shown in FIG. 40, only the forward portion of the apparatus being shown, and comprises shafts 377, one in front and one in the rear, sprockets 378 and 379 and an additional pair in the rear (not shown), a pair of endless chains 380 and 381, and a plurality of partitions 382 mounted on the chains. A motor (not shown) drives the assembly. During the finishing process the chains and partitions may remain stationary, isolating the individual parts. When it is desired to discharge the parts, the motor is started, causing the partitions to move and push the parts along the chamber, ultimately discharging the parts from the finishing machine and returning on the upper flight back to the starting portion of the finishing machine.

Figure 42:
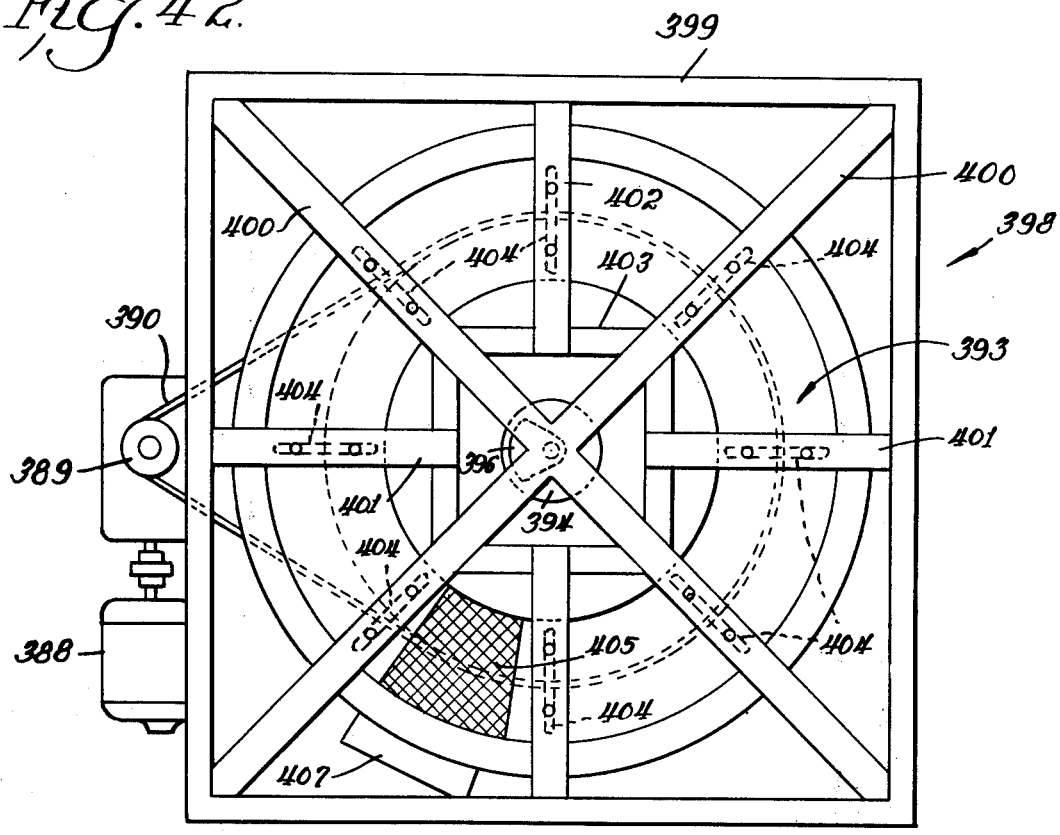
FIG. 42 is a top view of still another embodiment of the invention.
Figure 43:
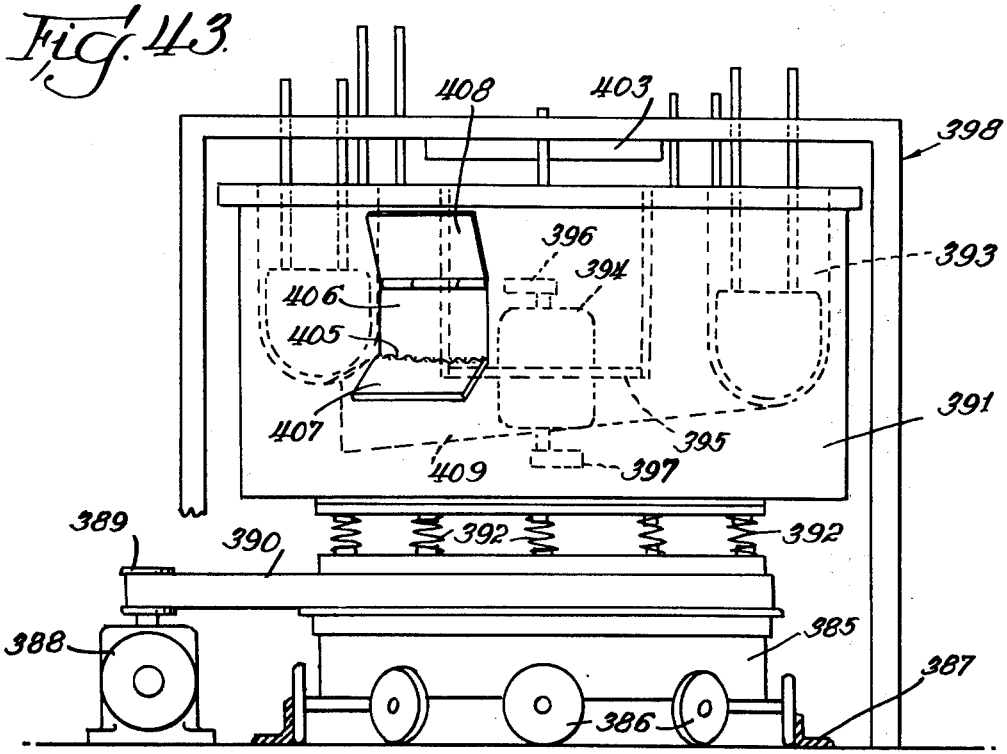
FIG. 43 is a side view of the apparatus shown in FIG. 42.

FIGS. 42 and 43 illustrate a further modified embodiment of the invention in which the partitions and their support remain fixed while the finishing chamber moves with respect to the partitions. The finishing machine comprises a base 385 mounted on a plurality of wheels 386 retained within an annular guide 387. The structure is rotated by means of a motor and gear reduction assembly 388 driving a pulley 389 which rotates the base 385 by means of an endless belt 390. A floating support 391 is mounted on the base 385 by means of springs 392. The base 391 supports an annular finishing chamber 393. A motor 394 is mounted on a motor support 395 and is provided with eccentric weights 396 and 397 at the ends of its shaft. A skeleton frame is fixedly mounted and is provided with a plurality of frame members 399, 400, 401, 402, and 403 supporting a plurality of partitions 404. A screen 405 is provided for separating the finishing material, and an exit port 406 is provided for discharging parts to an exit chute 407. A door 408 is provided for closing the exit port during the finishing operation. When finishing is complete, the motor 388 is caused to operate, rotating the finishing chamber 393. Since the parts are maintained in fixed position by the stationary partitions 404, when the door 408 is opened and the exit port reaches each part, the finishing material is separated and returned through a return duct 409 to the finishing chamber, and the part is discharged to the exit chute 407 and into a suitable receptacle or assembly line (not shown). During the finishing process the partitions isolate the parts to prevent damage by collision.

Referring to FIGS. 44 and 45, a different embodiment of the invention is shown comprising a linear finishing chamber 414 in the form of a linear trough having an arcuate bottom. The trough is mounted for vibration on a plurality of springs 415 which are in turn mounted on a fixed base (not shown). A motor 416 having eccentric weights 417 and 418 is mounted to the bottom of the finishing chamber, with the weights mounted on the motor shaft. These weights may be either in or out of phase with each other, depending upon whether the trough is or is not slanted toward its outlet. Within the chamber 414 are a plurality of partitions 419 connected to a chain 420. The chain 420 is commonly known as a self-supporting chain and has a structure so arranged that each link can bend only to horizontal in one direction and to a predetermined minimum radius in the other direction. Consequently, the upper flight of the chain is self-supporting and need not be supported on rollers or sprockets. The chain is similar to that disclosed in U.S. Pat. Nos. 3,448,953, 3,448,954, 3,503,578, 3,503,579, and 3,504,864. In operation, the vibration produced by the motor and eccentric weights causes the parts and finishing material to encounter orbital action transversely to the finishing chamber and also precession forwardly along the finishing chamber. This causes the parts to bear on the partitions 419 and to move them forward. As the partitions reach the forward portion of the apparatus they encounter a ramp 421 and a separating screen 422. The finishing material falls through the screen and is separated from the part, and returns through a duct 423 to an opening 424 in the starting portion of the finishing chamber.

FIG. 46 illustrates a linear-type of finishing machine in which the finishing chamber moves and the part-isolating means are stationary with respect to horizontal movement. The apparatus comprises a base 430 mounted on wheels 431 which run on tracks or guides 432. The base may be driven by a motor, hydraulic cylinder, or any other suitable means (not shown). Mounted on the base 430 by means of springs 433 is a finishing chamber 434 in the form of a linear trough having an arcuate bottom. A motor 435 is mounted on the bottom of the finishing chamber and is provided with eccentric weights 436 and 437. The means for isolating parts comprises a support member 438 mounted on a fixed supporting base 439. A plurality of insert bushings 440 are provided in the support member 438. A plurality of partitions 441 are provided with vertical guide rods 442 which are slidably journaled in the channels of the insert bushings 440. Caps 443 are affixed to the ends of the guide rods 442 to prevent them from sliding through the insert bushings. A cam slot 444 is mounted on the finishing chamber, and cam follower pins 445 are affixed to the vertical guide rods 442 and ride in the cam slot 444. A ramp screen 446 is provided in the forward portion of the finishing chamber terminating with a part receptacle 447.

In operation, parts and finishing material are placed in the finishing chamber 434 with one or more parts placed in each compartment defined by a pair of partitions 441. When the motor 445 is started, the chamber is caused to vibrate, thereby promoting finishing of the parts. Either during the finishing process or at the end of the finishing process the base 430 is caused to move to the right of the view shown in FIG. 46. As a result, the partitions 441 hold the parts. As each part reaches the screen 446 it rises and the finishing material is separated from the part and drops into a tube 448 and returned by vacuum or other means to the starting portion of the finishing chamber. As each part rises over the screen 446 it is pushed by the partition 441 into a receptacle or hopper 447. The cam slot 444 guides the partitions and maintains them at the proper level. When the partitions reach the screen 446 the ascending portion 449 of the cam slots raises the partitions so that they clear the screen ramp 446. The cam follower pins 445 then go down the descending portion 450 of the cam slots and leave the cam slots through the enlarged portion 451 thereof. The caps 443 support the rods 442 when they are no longer engaged in the cam. After the batch of parts have been finished, the base 430 is moved to the left, the cam follower pins 445 entering the enlarged portion 451 and engaging in the cam slots 444. Parts can then be loaded and the process continued. The movement of the base 430 may be carefully controlled to provide precise control of the finishing cycle and finishing of the parts. The movement of the base 430 may be controlled at any speed, stopped, or increased in speed so that the period during which each part is finished may be very precisely controlled.

FIGS. 47–51 show still another embodiment of the invention, comprising a base 455 and a finishing chamber 456 mounted similarly to that of FIGS. 1–4. The finishing chamber is designed to receive a plurality of foraminous baskets 457 in which one or more parts may be placed. During the finishing operation the parts within the basket and finishing material are vibrated together, the basket proceeding along longitudinally in the chamber as a result of precession. The chamber 456 has a lower loading portion 458 and a discharge zone 459 at an upper elevation. As each basket containing a part for parts 460 enters the discharge zone 459, the rear wall of the basket engages a tripping mechanism 461 which actuates a cylinder 462 causing a discharge member 463 of the separating screen to tilt forward, as shown in FIG. 49, causing the basket 457 to tilt and to discharge the part 460 onto the discharge ramp 464. The basket then continues down the descending portion 465 of the chamber to the loading portion 458 where one or more additional parts may be loaded into the empty basket.

Referring to FIGS. 52 and 53, a finishing chamber 468 is shown having a plurality of foraminous cylindrical baskets 469 disposed therein. As shown in FIG. 53, each basket comprises a primary body portion 470 and a cover 471 hingedly mounted thereon. Compression latches 472 are provided for securing the cover 471 which is spring loaded to the open position. During the finishing process the baskets contain the parts and isolate them from adjacent parts, moving along the chamber by precession. When the baskets reach the separation zone, the finising material falls through the foraminous basket walls and through a screen provided therefor. The baskets continue until they pass through a constricting actuating ring 473 which opens the latches and permits the parts to leave the baskets and to be discharged from the finishing chamber in usual manner. FIG. 54 illustrates a part-isolating compartment-defining means in the form of a foraminous sphere 477 having two halves 478 and 479 fastened together by a hinge 480. A latch 481 latches the two halves together after a part has been placed therein. The sphere is inserted into a finishing chamber of any type described, and permits the part or parts contained therein to be finished while isolating them from other parts. The finishing material is subsequently separated in usual manner and the entire sphere discharged from the finishing machine. The part can then be removed and another part loaded in the sphere and placed in the loading portion of the finishing chamber. It is readily adaptable to all kinds of existing equipment.

FIG. 55 illustrates still another embodiment comprising a finishing chamber 484 in the form of a linear trough mounted for vibration on springs 485 which are in turn mounted on a fixed base (not shown). A motor 486 having eccentric weights 487 and 488 is mounted on the bottom of the finishing chamber 484. A separation zone is provided having a separation screen 489 and a finishing material-receiving receptacle 490. A part discharge port 491 is provided leading to a discharge chute 492. Rotatively mounted in the finishing chamber is an auger or twisted ribbon 493 coupled to a pulley 494 driven by a motor 495 through a pulley 496 and endless belt 497. The level of parts and media in such device is maintained at or below the axis of the auger, so as not to impede proper motion of the mass within the chamber, and the adjacent blades of the auger cooperate with the walls of the finishing chamber to define compartments therein.

In operation, the parts and finishing material are placed in the finishing chamber 484 in the portion shown at the left of the view shown in FIG. 55. The motor 486 is then started causing the parts and finishing material to vibrate and the parts to become finished. Either during the process or at the end of the finishing process the motor 495 may be started causing the auger 493 to rotate and to drive the parts and finishing material forward. When the parts reach the portion of the chamber shown at the right of the view of FIG. 55, the finishing material is separated by the screen 489 and falls into the receptacle 490, and the part is discharged through the discharge port 491 onto the discharge chute 492. The finishing process may be precisely controlled by controlling the speed of the motor driving the auger, slowing it up or stopping it entirely for any desired period.

Figure 56:
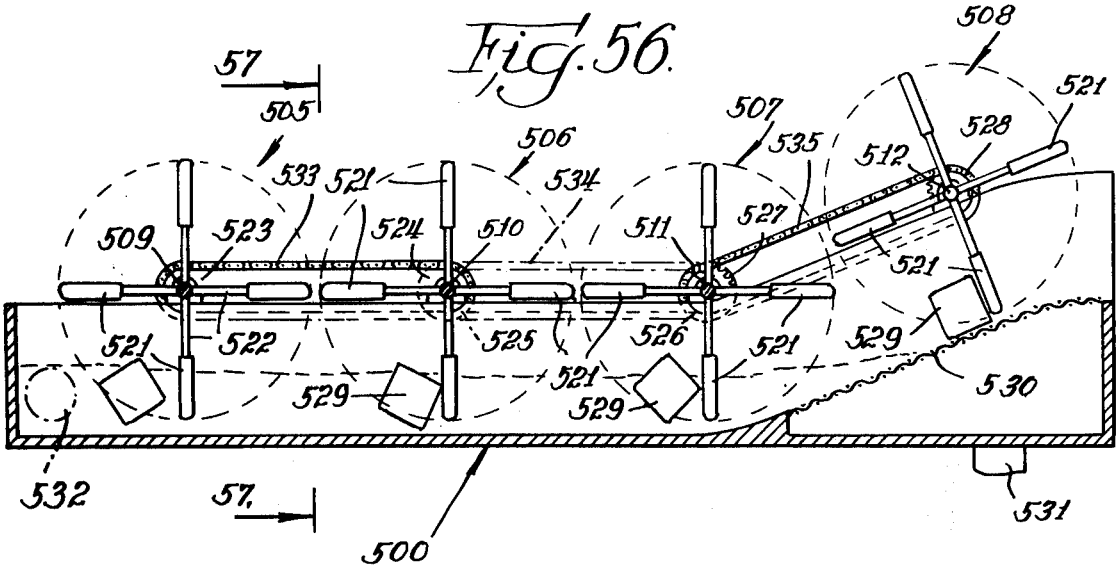
FIG. 56 is a fragmentary side elevational view of another embodiment of the invention.
Figure 57:
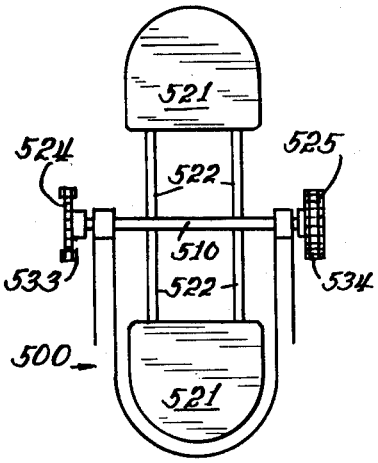
FIG. 57 is a cross-sectional view taken at the line 57—57 of FIG. 56, looking in the direction of the arrows.

Referring to FIGS. 56 and 57, another embodiment is shown of the type where the partitions do not follow the parts along the entire length of the finishing chamber, but move substantially vertically to permit the parts and the chamber surrounding the parts to move from one set of cooperating partitions to another. The apparatus shown comprises a linear finishing chamber 500 mounted for vibration in normal manner, as for example using springs and base such as shown in FIGS. 44 and 46. Alternatively the structure may be utilized in combination with an annular type of finishing chamber. Mounted on the finishing chamber are a plurality of turnstyles 505, 506, 507, and 508 comprising shafts 508, 510, 511, and 512 journaled in bearings. Partitions 521 are affixed to the shafts by means of supports 522. A plurality of sprockets 523, 524, 525, 526, 527, and 528 are affixed to both ends of the shafts and are interconnected by chains 533, 534, and 535. The turnstyles are so synchronized, as shown in FIG. 56, that the lowermost partitions of pairs of adjacent turnstyles define a chamber in which a part or parts 529 residing in the chamber are isolated from other parts. As the parts move by precession and reach a partition, the assembly is moved, causing the partition to revolve 90° and the next position to come into vertical position behind the part, in effect placing the part and the compartment in which it resides into the next compartment. The parts 529 continue to move forward until they climb the screen ramp 530, where the finishing material is separated and each part discharged. The finishing material is removed through an outlet 531 and caused to reenter in an inlet 532, as by vacuum or other type conveyor.

Figure 58:
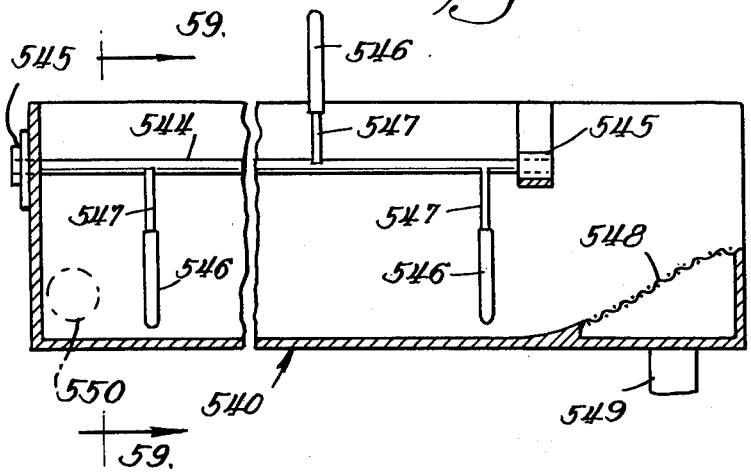
FIG. 58 is a fragmentary side elevation view of an additional embodiment of the invention.
Figure 59:
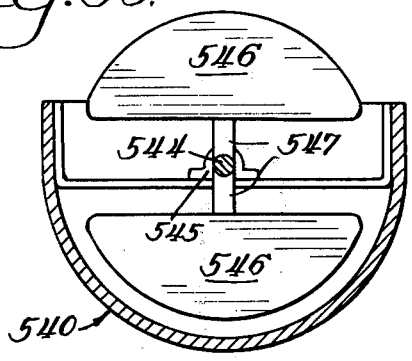
FIG. 59 is a cross-sectional view taken at the line 59—59 of FIG. 58, looking in the direction of the arrows.

FIGS. 58 and 59 illustrate an embodiment comprising a finishing chamber 540 mounted for vibration similarly to that of FIGS. 44 and 46, having a longitudinal shaft 544 mounted on bearings 545. A plurality of partitions 546 are provided with supporting arms 547 affixed at their ends to the shaft 544. The arrangement is such that adjacent partitions are oriented 180° with respect to each other. Consequently, alternate partitions which are positioned within the finishing chamber at a given time cooperate to define a chamber and isolate the part or parts contained in the chamber from other parts. As the part or parts in a chamber reach the partition by precession, the shaft is rotated until the partition is raised to permit the part to advance to a succeeding chamber formed by a new pair of partitions which have gone into position by the 180° rotation of the shaft. Eventually, each part and finishing material climbs the screen ramp where finishing material is separated and passes through outlet 549 and reenters by inlet 550, while the part is discharged.

Figure 60:
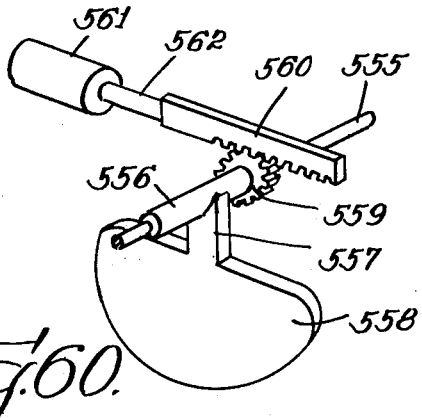
FIG. 60 is a perspective view of still another embodiment of the invention.

FIG. 60 shows an assembly somewhat similar to that of FIGS. 58 and 59, but wherein the partitions are mounted on individual longitudinal shafts. The structure is adapted to be mounted on either a curvilinear, e.g., annular, or linear finishing chamber, and comprises a shaft 555 adapted to be affixed longitudinally over the center of the finishing chamber, a sleeve 556 journaled thereover, and a supporting arm 557 and partition 558 affixed to the sleeve 556. A pinion 559 is affixed to the sleeve 556 and is cooperatively engaged by a rack 560 driven by a solenoid 561 and operating arm 562.

The operation of the embodiment of FIG. 60 is similar to that of FIGS. 24 and 25, except that the partitions revolve instead of lifting in translatory movement. Alternatively the partition structures of FIGS. 22 and 23 may be adapted to operate in similar manner.

By "finishing material" or "finishing media" or "medium," as these terms are used herein, it is intended to include loose, comminuted, granular, or particulate, and in any event, solid finishing materials of the type which are presently employed in the trade and any others of a similar nature. Although liquid finishing materials may be used in conjunction with the solid finishing material these are considered to be ancillary for purposes of the present invention which in all cases employs at least some solid finishing medium for the process of the invention. Moreover, the terms first set forth in this paragraph are used herein generally to designate such solid materials which are used to impart all types of finishes including those finishes acquired with abrading materials as well as with polishing materials, and "polishing" is to be considered in its usual sense as one species of "finishing."

As used herein in the specification and claims, the term "compartment" denotes the spacial configuration defined by surfaces of adjacent part-isolating means of the invention and within which spacial configuration or area the part or parts are positioned. In the embodiment where the part-isolating means comprises a plurality of transverse partitions, the compartment is defined by the surfaces of adjacent partitions and by the sides and bottom of the finishing chamber. In the embodiments in which the part-isolating means are baskets, the compartment is defined by the end walls, side walls, and bottom of the baskets. In the embodiment in which spheres or bodies of related spacial configuration are utilized as the part-isolating means, the walls of adjacent parts-isolating means together with the walls and bottom of the chamber define the compartment. In the embodiment in which the part or parts are positioned within a sphere or similar type of closed body, the walls of the body define the compartment. In all the above embodiments except those wherein the part-isolating means, e.g., partitions or dividers, move vertically with respect to the finishing chamber, the walls of the part-isolating means move longitudinally with the compartment in which the part or parts are positioned.

In the embodiment illustrated in FIGS. 24 and 25, the partitions 254 are arranged to move only vertically and not longitudinally along the finishing chamber. At any given moment each compartment is defined by the surfaces of adjacent partitions. As described above, the parts are advanced along the trough by raising the partitions successively or by raising alternate partitions and by placing parts only in alternate compartments. Within the concept of the method of the present invention, when a partition is raised, the boundary of the compartment previously defined by the surfaces of the adjacent partitions moves with the parts into the space defined by the raised partition and up to the succeeding closed partition. When the partition is again lowered, the boundary of the compartment is again changed, this time by shortening the compartment, although it is still defined by surfaces of adjacent partitions. Consequently, within the concept of the invention the compartment in which the part is positioned virtually moves longitudinally with the part upon each partition actuation, even though the partitions themselves remain stationary with respect to a longitudinal direction. The compartment thus virtually follows the part along the finishing chamber until the part is ultimately discharged from the finishing apparatus.

The finishing apparatus of the present invention has many advantages over conventional equipment shown in the art. There is presently no apparatus disclosed which is able to finish precision machine parts or large parts and wherein the parts may be introduced automatically and removed automatically. Currently available equipment utilizes a spindle-type abrasive deburring machine with the part to be finished fixtured on a spindle. This involves loading, unloading, and a special fixture for each part. This technique can also be employed with a rotating barrel or a vibrating tub, either round or straight-line, but the disadvantages are the same.

The primary advantage offered by the present invention is that finishing machines may be utilized which have automatic loading and automatic unloading and still, by means of the various forms of the present invention which define individual compartments for each precision part to be finished, the parts are maintained separated from all other parts and ultimately automatically discharged. Additionally, the present invention permits more sophisticated and precision control of the time cycle and dwell time of the parts within the finishing chamber. Following are some of the advantages of the present invention:

1. Absolutely controlled and reproducible time cycles.
2. Processing of either large or small parts.
3. Complete isolation of one part(s) from other part(s) to eliminate nicking or scratching of parts.
4. Exact distribution of parts in available capacity of machine.
5. Improved automatic separation of parts from media because the part is in the separation zone at a known time for a known period, and therefore means such as an air cylinder or solenoid-operated kicker or special device can be utilized to eject the part from the machine.
6. Automatic loading and unloading of the machine by conveyor devices from and to other machines made possible because of the precision control of the time cycle and part location.

The basic principle of the invention and the apparatus disclosed may additionally be applied to any type of tumbling mass machine either vibrational or rotational.

The precision capabilities of the machine are made possible by the fact that the partitions or other means defining compartments may be permitted to move passively with the parts and finishing material, may be retarded to any desired degree or may even be stopped for a predetermined or desired period.

It is to be understood that the invention is not to be limited to the exact details of operation or structures shown and described, as obvious modifications and equivalents will be apparent to one skilled in the art.

I claim:

1. Apparatus for treating the surface of parts or workpieces with loose finishing material while maintaining parts isolated from other parts and to prevent damage to parts as a result of collision therebetween, having a resiliently-supported vibratory finishing chamber in which the workpieces are vibrated with the finishing material, and in which the part-isolating means comprises partitions for separating the interior of the finishing chamber into individual compartments defined by adjacent partitions characterized in having, means for supporting said partitions for movement along said finishing chamber and means for supporting said partitions for vibratory movement together with the contents of the finishing chamber, in having a discharge zone for discharge of the contents of an individual compartment when said individual compartment is in said discharge zone, in that said discharge zone comprises discharge port means, and in that said adjacent partitions for part-isolation in said finishing chamber are spaced so as to straddle said discharge port means for discharge of the contents of an individual compartment, disposed between adjacent partitions, when said individual compartment is in said discharge zone and said discharge port means is in open or discharge position.

2. Apparatus of claim 1, wherein said finishing chamber has a substantially horizontal arcuate bottom.

3. Apparatus of claim 1, wherein said finishing chamber has an arcuate bottom with a rise therein.

4. Apparatus of claim 1, comprising separation means in cooperation with said discharge port for separation of finished parts from finishing material.

5. Apparatus of claim 4, wherein said separation means is internal of said finishing chamber.

6. Apparatus of claim 4, wherein said separation means is external of said finishing chamber.

7. Apparatus of claim 1, wherein said finishing chamber is annular.

8. Apparatus of claim 1, including means for retarding or stopping the movement of said part-isolating means along said finishing chamber.

9. Apparatus of claim 1, wherein said support means comprises a revolvable structure.

10. Apparatus of claim 9, wherein said finishing chamber is annular and said support means comprises a turntable.

11. Apparatus of claim 1, wherein said part-isolating means is mounted by support means which cooperate with a rise in said bottom of said finishing chamber to permit said part-isolating means to clear said rise.

12. Apparatus of claim 11, wherein said part-isolating means is mounted to permit upward or pivotal movement thereof.

13. Apparatus for treating the surface of parts or workpieces with loose finishing material while maintaining parts isolated from other parts and to prevent damage to parts as a result of collision therebetween, having a resiliently-supported vibratory finishing chamber in which the workpieces are vibrated with the finishing material, and in which the part-isolating means comprises partitions for separating the interior of the finishing chamber into individual compartments defined by adjacent partitions, characterized in that the partitions are adapted and arranged for movement along said finishing chamber and wherein means are provided for supporting said partitions for such movement and for vibratory movement with said finishing chamber, in having a discharge zone for discharge of contents of an individual compartment when said individual compartment is in said discharge zone, in that said discharge zone comprises discharge port means, and in that said adjacent partitions for part-isolation in said finishing chamber are spaced so as to straddle said discharge port means for discharge of contents of an individual compartment, disposed between adjacent partitions, when said individual compartment is in said discharge zone and said discharge port means is in open or discharge position.

14. A process for finishing a part or parts in a finishing chamber by vibration together with loose finishing material including the step of imparting movement to said finishing chamber to cause parts contained therein to be finished by interaction with finishing material and to cause said parts and finishing material to move along said finishing chamber while maintaining said part or parts and finishing material in a compartment defined in said finishing chamber by part-isolating means comprising a plurality of partitions in said finishing chamber, said partitions being mounted for movement along said finishing chamber and supported for vibration with said finishing chamber, characterized in that it includes the steps of vibrating said partitions with said finishing chamber and moving an individual compartment with its parts and finishing material along said chamber to a discharge zone and discharging contents of an individual compartment when said compartment is in said discharge zone.

15. Process of claim 14, including the step of separating the part or parts in that compartment from finishing material while said compartment is in said discharge zone but before discharging said part or parts.

16. A process according to claim 15, wherein the movement of said partitions is retarded or stopped during a portion of the finishing process to permit the finishing period to be increased.

* * * * *